US005904163A

United States Patent [19]

Inoue et al.

[11] Patent Number: 5,904,163

[45] Date of Patent: May 18, 1999

[54] DISHWASHER FOR WASHING DISHES BY ROTATING A DISH WASHING BASKET AND DISH WASHING BASKET THEREFOR

[75] Inventors: Yoshifumi Inoue, Osaka; Yasuhiro Sakoda, Wakayama; Hirokazu Nishio, Osaka; Kenji Kimura, Osaka; Eijirou Iguchi, Osaka; Takeshi Tanabe, Osaka; Tetsuichi Arita, Osaka; Mituo Oouchi, Hyogo, all of Japan

[73] Assignee: Sharp Kabushiki Kaisha, Osaka, Japan

[21] Appl. No.: 08/900,861

[22] Filed: Jul. 25, 1997

[30] Foreign Application Priority Data

| | | | |
|---|---|---|---|
| Jul. 26, 1996 | [JP] | Japan | 8-198080 |
| Oct. 23, 1996 | [JP] | Japan | 8-279767 |

[51] Int. Cl.[6] ..... B08B 3/02

[52] U.S. Cl. ..... 134/56 D; 134/58 D; 134/200; 134/153; 134/113; 134/148

[58] Field of Search ..... 134/56 D, 57 D, 134/58 D, 135, 201, 200, 140, 102.3, 113, 148, 153, 48, 52

[56] References Cited

U.S. PATENT DOCUMENTS

| | | | |
|---|---|---|---|
| 575,368 | 1/1897 | Nolen, Jr. | 134/148 |
| 1,143,217 | 6/1915 | McGrath | 134/148 |
| 1,332,712 | 3/1920 | Couch | 134/153 |
| 1,396,466 | 11/1921 | Roever | 134/148 |
| 1,843,126 | 2/1932 | Geocares | 134/148 |
| 2,437,968 | 3/1948 | Palotsee | 134/140 |
| 2,598,074 | 5/1952 | Sadwith | 134/153 |
| 2,643,659 | 6/1953 | Auten | 134/148 |
| 3,133,547 | 5/1964 | Dannenmann et al. | 134/140 |
| 3,460,550 | 8/1969 | Zanssui | 134/153 |
| 3,465,761 | 9/1969 | Meeker et al. | 134/200 |
| 4,143,669 | 3/1979 | Minkin | 134/153 |
| 4,191,592 | 3/1980 | Hansen | 134/48 |
| 5,482,066 | 1/1996 | Krueger | 134/153 |

FOREIGN PATENT DOCUMENTS

| | | | |
|---|---|---|---|
| 3314992 | 10/1984 | Germany | 134/56 D |
| 3640054 | 6/1988 | Germany | 134/56 D |
| 3644053 | 6/1988 | Germany | 134/56 D |
| 62-183393 U | 11/1987 | Japan . | |
| 4100931 U | 9/1992 | Japan . | |
| 5-115404 | 5/1993 | Japan | 134/56 D |
| 611665 U | 2/1994 | Japan . | |
| A-7289492 | 11/1995 | Japan . | |
| A-7303592 | 11/1995 | Japan . | |
| A-8-84963 | 4/1996 | Japan . | |

*Primary Examiner*—Frankie L. Stinson

[57] ABSTRACT

A dishwasher includes a cabinet having an opening, a door provided to open/close the cabinet opening, a washing chamber member provided in the cabinet and forming a washing chamber facing the opening, a washing nozzle provided facing in a certain direction of the washing chamber, a circulation pump coupled to the washing nozzle, the bottom portion of washing chamber and an external drain outlet, a driving source provided outside the washing chamber, a power transmission mechanism provided at a corner on one side in cabinet behind and outside the washing chamber, and a control circuit controlling the circulation pump and driving source. By the power transmitting mechanism, a dish washing basket placed in the washing chamber is rotated. Since the power transmitting mechanism is placed in a corner behind the washing chamber, the dishwasher can be made smaller.

19 Claims, 26 Drawing Sheets

FIG.30

| INDICATING PORTION | | PORTIONS TO BE CHECKED UP |
|---|---|---|
| WASHING CONDITION INDICATING PORTION | DRYING CONDITION INDICATING PORTION | |
| STANDARD | DISH WARMING | DRAIN FAILURE<br>· DRAIN HOSE BENT?<br>· WASHING FILTER CHOKED? |
| LIGHT | ELABORATE | DISH BASKET ROTATION FAILURE<br>· DISH MISPLACED AND TOUCHING CHAMBER WALL? |
| STANDARD | STANDARD | WATER FEED FAILURE<br>· WATER VALVE OPEN?<br>· SERVICE WATER AVAILABLE?<br>· SERVICE WATER · WATER FEED HOSE FREEZED? |
| STANDARD | ELABORATE | |

FIG.31

· NECESSARY TIME WITH 0.3MPa WATER PRESSURE (3kgf/cm$^2$), ROOM TEMP. 20℃, WATER TEMP. 20℃ · 60℃ WATER FEED (DEPENDS ON WATER PRESSURE, WATER TEMPERATURE & ROOM TEMPERATURE)

| COURSE OF OPERATION | NECESSARY TIME | | BREAKDOWN OF NECESSARY TIME (WATER TEMP.:20℃) | | | | | |
|---|---|---|---|---|---|---|---|---|
| | WATER TEMP.:20℃ | 60℃ WATER FEED | WASH (MIN.) | COLD WATER RINSE (MIN.) 1 | 2 | 3 | HOT WATER RINSE (MIN.) | DRY (MIN.) |
| STANDARD | (64MIN.) ELABORATE DRYING | | (15) | (1) | (1) | (1) | (19) | (10) ELABORATE DRYING (30) |
| HEAVY | (83MIN.) ELABORATE DRYING | | (25) | (2) | (2) | (2) | (30) | (10) ELABORATE DRYING (30) |
| LIGHT | (57MIN.) ELABORATE DRYING | | (10) | (1) | (1) | (1) | (17) | (10) ELABORATE DRYING (30) |
| WASH ONLY | (53MIN.) HEAVY DIRT | | (15) (25) | (1) | (1) | (1) | (19) (30) | |
| DRY ONLY | 50MIN. (70MIN.) ELABORATE DRYING | | | | | | | (30) |
| DISH WARMING | | | | | | | | (30) (30) KEEPING WARM |

DISHWASHER FOR WASHING DISHES BY ROTATING A DISH WASHING BASKET AND DISH WASHING BASKET THEREFOR

BACKGROUND OF THE INVENTION

1. Field of the Invention

The present invention relates to a dishwasher for washing dishes by jetting washing water. More specifically, the present invention relates to a dishwasher for washing dishes by jetting water to a dish washing basket which contains dishes and is rotated.

2. Description of the Background Art

A conventional dishwasher is disclosed in Japanese Utility Model Laying-Open No. 62-183393. The conventional dishwasher includes, referring to FIG. 41, a washing tank 101, a turntable 101 provided in washing tank 101, a container rack 102 for placing dishes on turntable 100, a water jet pipe 103 for jetting water, provided on an inner surface of washing tank 101 and having a nozzle formed over height direction of container rack 102, and a driving apparatus 104 provided below washing tank 101 for rotating turntable 100.

The dishwasher operates in the following manner. Dishes are placed on turntable 100. While turntable 100 is rotated by driving apparatus 104, water is jetted out from water jet pipe 103 to the dishes, and the dishes are washed.

In such a conventional dish washer, the driving apparatus for rotary driving the turntable is arranged below the turntable. This makes the dishwasher higher and larger. Further, in a conventional dishwasher, arrangement of water jet pipe for jetting water, water inlet and so on has not been well considered, and therefore a space in the box is not well utilized.

Most of commercially available dishwashers use a rotating nozzle and not a turntable such as described above. A control circuit for a dishwasher using a rotary nozzle is disclosed, for example, in Japanese Patent Laying-Open Nos. 7-289492 and 7-303592. The control circuit of the conventional dishwasher includes electric parts such as a pump, heater, and a fan connected parallel to a power source through switches.

It has been described in Japanese Utility Model Laying-Open No. 6-11665 that drying finish of dishes is improved when a rinsing agent is dropped into the washing tank after washing. The rinsing agent helps draining after rinsing, and thus prevents water marks on the dishes after drying.

Further, Japanese Utility Model Laying-Open No. 4-100931 discloses a business use dishwasher having a function of easy demonstration for sales promotion.

Of the dishwashers, one washing dishes using a turntable is more advantageous than the one in which jet nozzle rotates, in that articles or dishes can be washed more uniformly. However, conventionally, the technique necessary for using the turntable has not been sufficiently considered, and therefore advantages of the turntable type apparatus have not been fully exhibited. Specifically, a display portion showing set operation or process which is being done is not provided on a control panel, and therefore the user cannot have sufficiently detailed information of the process of dish washing. Therefore, the conventional dishwasher has poor operability. Further, conventionally, failure in operation by some cause cannot be well addressed, especially failure or difficulty derived from the use of the turntable has not been well addressed. When there is a malfunction in the turntable driving system, for example, it is difficult to access the defective portion for repair. In other words, the serviceability is poor. Further, family use dishwashers do not have any demonstration function. This makes sales activity difficult at shops. Further, if a family use dishwasher were provided with demonstration function, the demonstration function might have been mistaken as a failure as the dishwasher operates in a different manner if the user started the demonstration function unknowingly.

SUMMARY OF THE INVENTION

Therefore, an object of the present invention is to provide a dishwasher for washing objects while rotating the same with improved operability.

Another object of the present invention is to provide a dishwasher for washing objects while rotating the same with improved operability and serviceability.

An additional object of the present invention is to provide a dishwasher having a demonstration function and improved operability and serviceability which is safe even at a time of failure.

A further object of the present invention is to provide a dishwasher having a demonstration function and improved operability and serviceability which is safe even at a time of failure and is free of any possibility of erroneous activation of the demonstration function.

The dishwasher according to the present invention includes a cabinet having an opening in front, a door attached to open/close the opening of the cabinet, a washing chamber member provided in the cabinet and forming a washing chamber facing the opening, a washing nozzle provided in a prescribed direction toward the washing chamber, a circulation pump coupled to the washing nozzle, a bottom portion of the washing chamber and an external drain opening, a driving source provided outside the washing chamber, a power transmission mechanism coupled to the driving source and provided at a corner of one side surface on the rear side of the cabinet outside the washing chamber in the cabinet, and a control circuit for controlling the circulation pump and driving source. By the power transmission mechanism, the dish washing basket placed in the washing chamber is rotated.

Since the power transmitting mechanism is arranged at a corner of the cabinet behind the washing chamber, the dishwasher can be made compact as compared with the conventional dishwasher in which the driving source is provided below the washing chamber.

The washing chamber member may have an opening at a corner where the power transmission mechanism is arranged, through which part of the power transmission mechanism faces the washing chamber. If the opening is used also as a water inlet, a space for providing the water inlet can be eliminated, and the dishwasher can be made smaller.

The washing nozzle may be arranged at a deep corner on the side opposite to the power transmission mechanism with respect to the washing chamber. By this arrangement, spaces at the corners of the cabinet can be well utilized and the dishwasher can be made smaller.

The dishwasher may further include a filter member placed on a water tank in the washing chamber and providing a bottom surface of the washing chamber. The filter member has a support portion supporting rotation axis of the dish washing basket provided at a prescribed position on the upper surface thereof. It is preferable that the upper surface of the filter member is made flush with other portions of the bottom surface, as rotation of the dish washing basket is not hindered.

The dishwasher may further include an operation panel connected to the control circuit. The control circuit performs demonstration of the dishwasher in response to a prescribed operation on the operation panel. Though it is a family use dishwasher, demonstration is possible, and therefore sales activity is facilitated. The control circuit may operate the dishwasher in a shorter operation cycle than a normal operation cycle in the demonstration of the dishwasher. Since the operation of the dishwasher which requires much time normally can be completed in a shorter period, it is appealing to potential users. For demonstration, a buzzer may be set off when a power key on the operation panel is pressed, so that the user may realize that it is a demonstration.

According to another aspect of the present invention, the dish washing basket used together with the dishwasher, which is placed in the washing chamber and rotated by the power transmission mechanism includes a disk shaped bottom portion, and a columnar pole formed approximately vertical to the top surface of the bottom from the center of the bottom portion. The bottom portion includes a plurality of radial ribs formed from an outer periphery at a lower portion of the pole toward the outer periphery of the bottom portion. Since the ribs are radial with the pole being the center, the water jetted from the jet nozzle goes from the outside to the center while the dish washing basket is being rotated, and uniformly hit all the dishes, thereby enabling efficient washing.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 30 shows a manner of displaying error on the operation panel of the dishwasher in accordance with one embodiment of the present invention.

FIG. 31 shows time periods necessary for various courses of operation.

DESCRIPTION OF THE PREFERRED EMBODIMENTS

Figure 1:
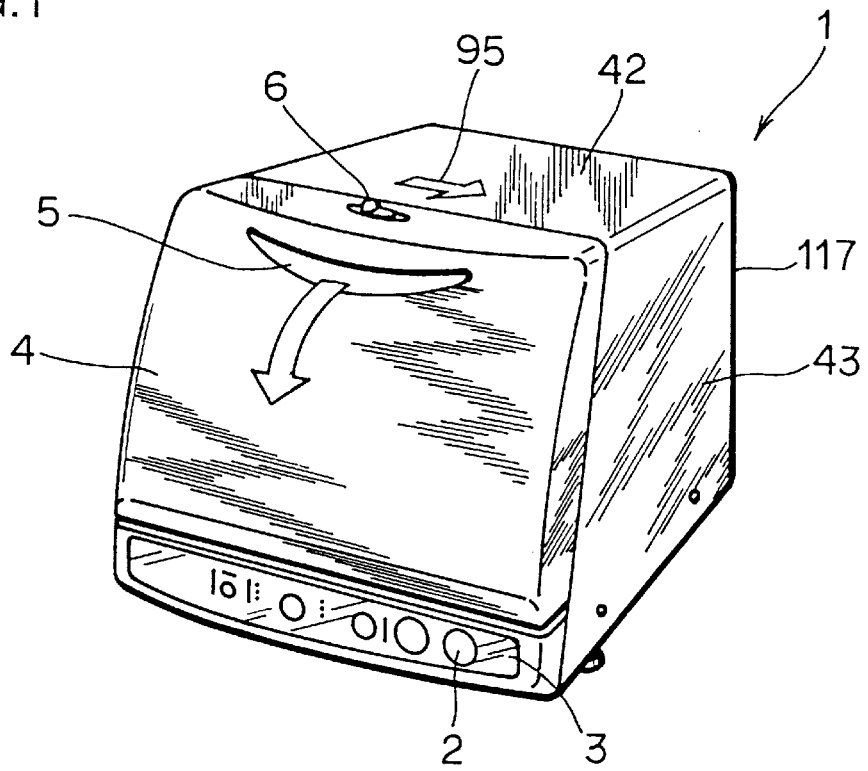
FIG. 1 shows appearance of a dishwasher in accordance with one embodiment of the present invention.
Figure 4:
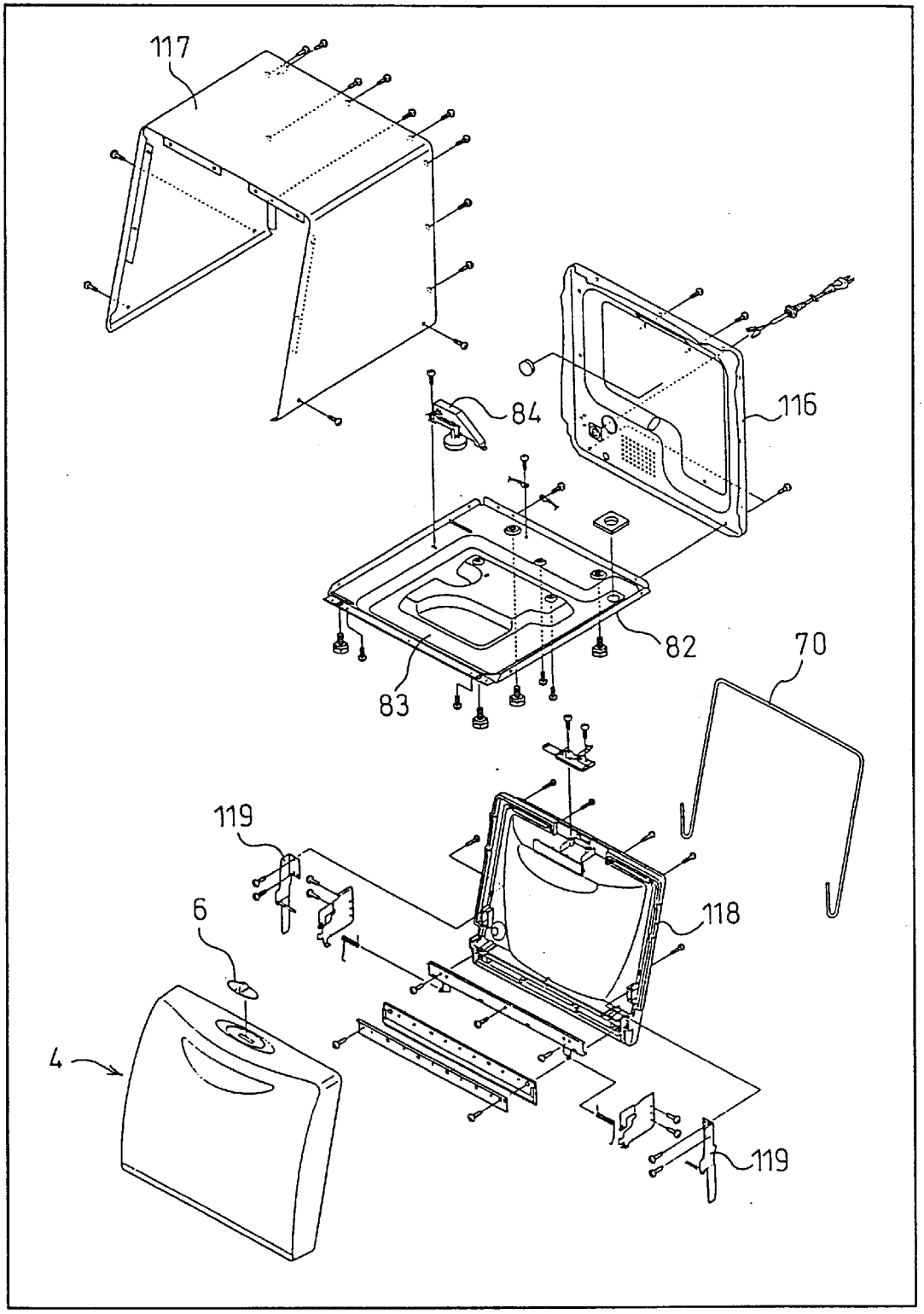
FIG. 4 is an exploded perspective view of the door and the cabinet.

Referring to FIGS. 1 and 4, a dishwasher 1 in accordance with one embodiment of the present invention includes a body cabinet 117, a vertically swing open door attached at a lower edge of the front opening of body cabinet 117 by means of a hinge, and an operation panel 3 provided below door 4 on a lower portion of the front surface of body cabinet 117, having power on/off key 2 and various switches. A knob 5 is provided at an upper portion of door 4. At a central portion on the upper end surface of door 4, there is provided a lock button 6 for locking the door 4 in the closed state. By closing the door 4 and sliding the lock button in the direction shown by the arrow 95 of FIG. 1, door 4 is locked and a tightly sealed washing chamber is formed in body cabinet 117. A front end of an upper wall 42 of body cabinet 117 is recessed from the surface of operation panel 3. Sidewalls 43 of body cabinet 117 have front edges recessed at the upper end.

Figure 2:
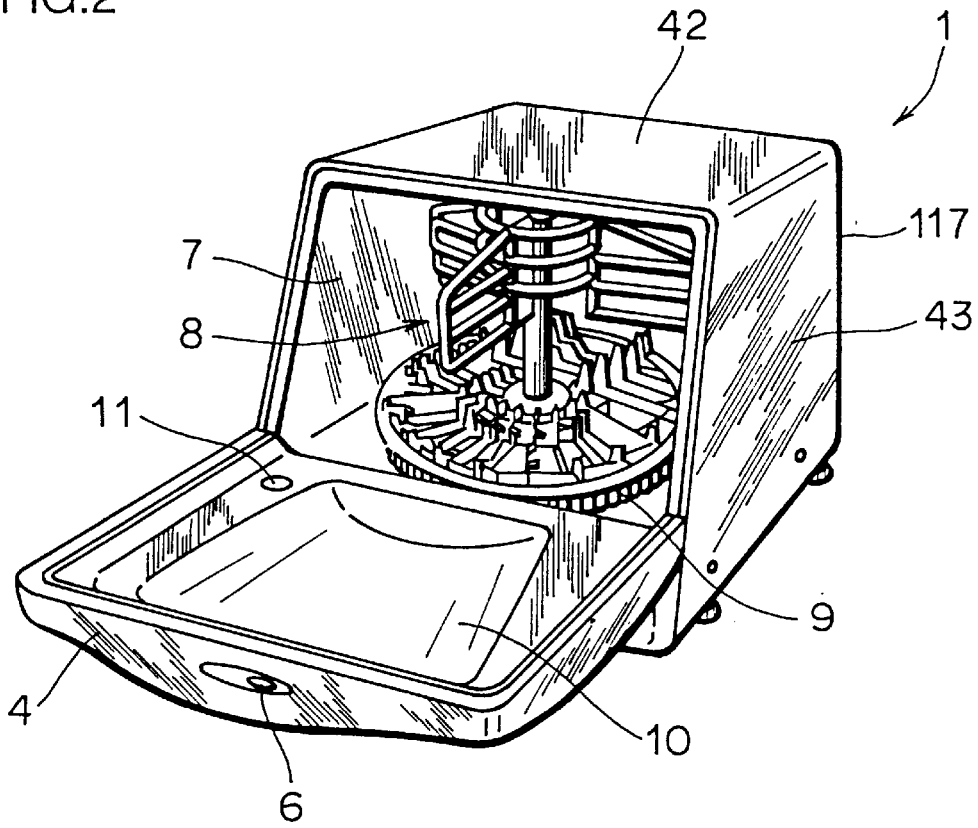
FIG. 2 shows appearance of the dishwasher of FIG. 1 with the door opened.

Referring to FIG. 2, when door 4 is opened, inner washing chamber 7 is viewed through the front opening of body cabinet 117. Dishwasher 1 further includes a dish washing basket 8 contained at the central portion of washing chamber 7, on which objects of washing such as dishes are placed. Lower portion of dish washing basket 8 has a circular appearance and a gear 9 is formed entirely over the external periphery thereof. Though not shown in FIG. 2, on a lower surface of dish washing basket 8, rollers are provided for dispersing and receiving weight of the objects to be washed and to help smooth rotation of the dish washing basket 8 about a prescribed axis.

Further, referring to FIG. 2, on an inner wall facing washing chamber 7 of vertically swing open door 4, there is provided a curved concave 10 formed not to hinder the rotation of dish washing basket 8. If the upper edge of the front opening of washing chamber 7 is recessed as described above, part of the objects to be washed may protrude forward from the opening. However, as the concave 10 is provided, the objects to be washed can be contained in washing chamber 7, and in addition, the object can be easily put in or taken out to and from the chamber. Further, the space in the washing chamber 7 can be partially formed on the side of the door 4, and therefore a large washing chamber is ensured in a compact body. A concave 11 for putting in detergent is formed at a lower portion of the inner surface of door 4.

Figure 3:
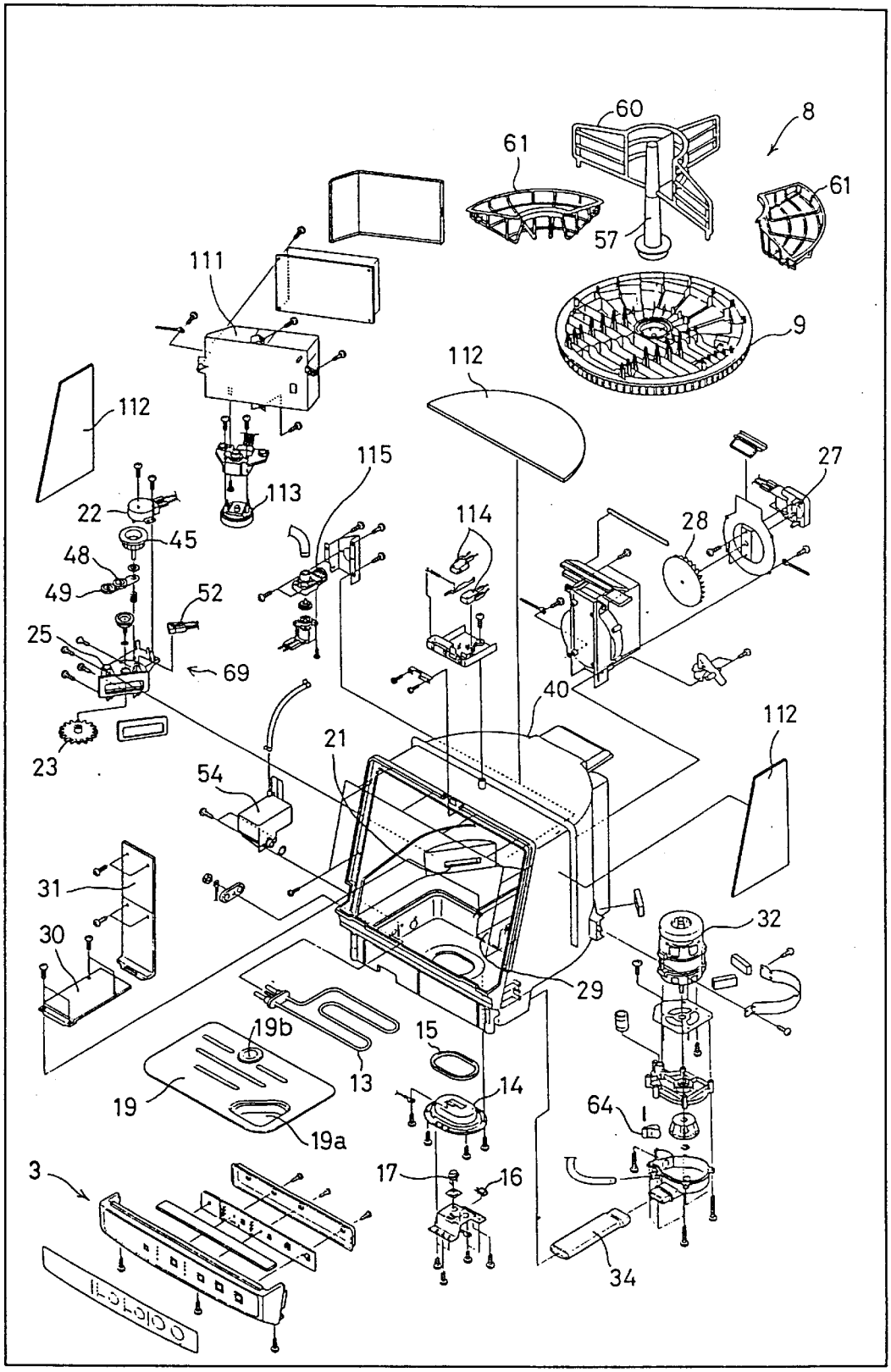
FIG. 3 is an exploded perspective view of the body of the dishwasher shown in FIG. 1.

The structure of the dishwasher in accordance with the present embodiment will be described with reference to the figures. FIG. 3 is an exploded perspective view of the dishwasher and FIG. 4 is a perspective view of the main portion. FIGS. 3 and 4 will be referred to as needed in describing various portions shown in FIG. 5 and the following.

Referring to FIG. 3, dishwasher 1 further includes an air blower motor 27 arranged on a rear surface side of washing chamber 7 for blowing air to washing chamber 7 to dry the objects, an air blower 28 rotated by air blower motor 27, and an air duct coupled to the air blower 28 and communicated with the washing chamber. Air blower motor 27 and air blower 28 are arranged at an upper portion as compared with the bottom surface of washing chamber 7. A printed board on which a microcomputer, which will be described later, is mounted for controlling dishwasher 1 is contained in a control box 111. Dishwasher 1 further includes an anti-vibration rubber 112 attached around the body, a detecting potion 113 to which an output of a water level sensor 54 is applied, and a water inlet 115 to which service water is supplied.

Referring to FIG. 4, a rear plate 116 is coupled to the rear surface of body cabinet 117. An inner door plate 118 is attached on the side opposing to body cabinet 117 of door 4 to be rotatable toward body cabinet 117 by means of a hinge 119. In this embodiment, a concave water pool portion 83 is provided at a peripheral portion of a bottom plate 82 of the cabinet. When there is a leak from the coupling portion between various parts and the washing chamber 4 or at a junction of washing chamber 4, the leaked water is held temporarily by the water pool portion 83.

Figure 5:
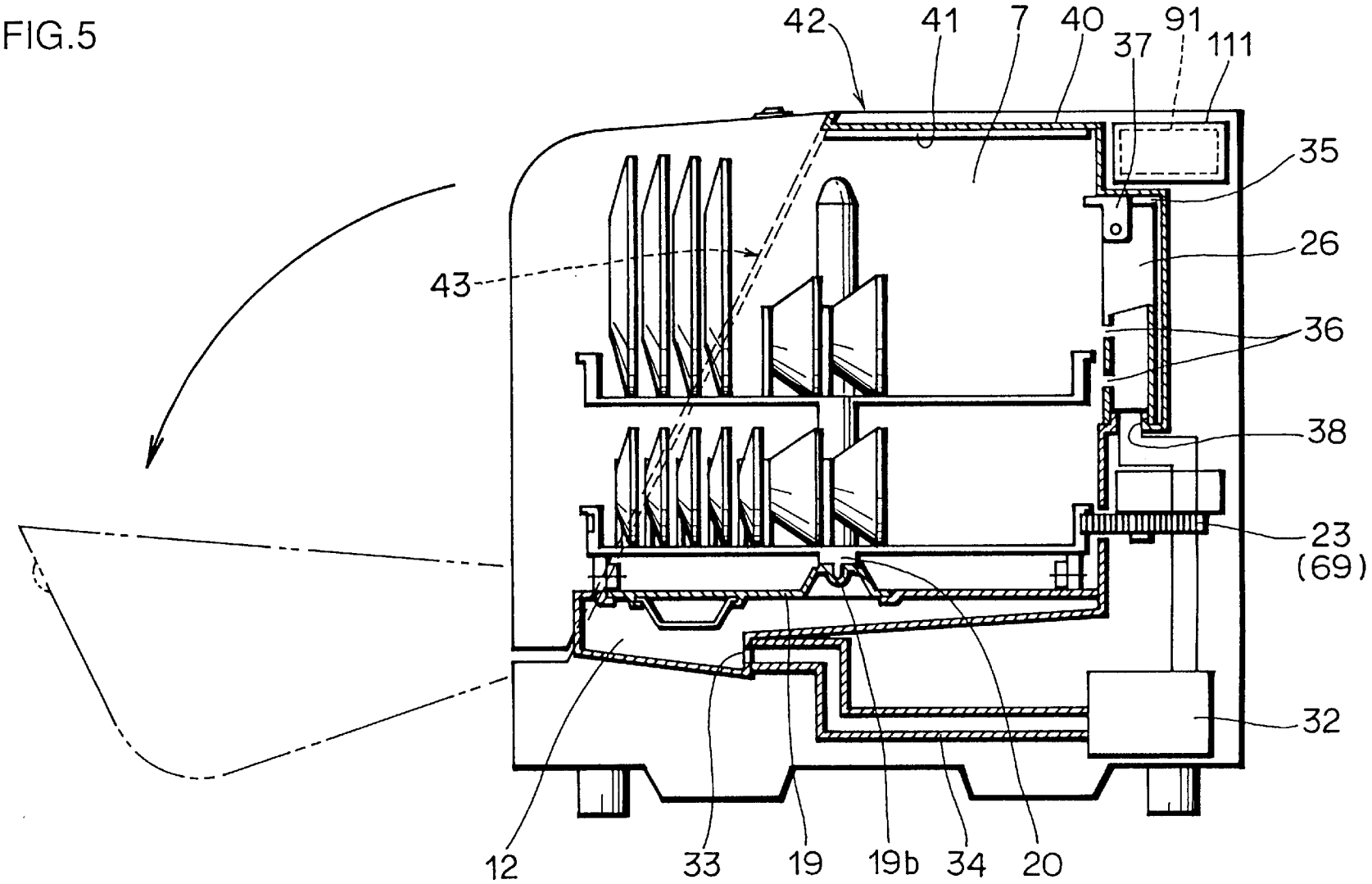
FIG. 5 is a vertical cross section of the side showing schematic structure of the dishwasher shown in FIG. 1.
Figure 6:
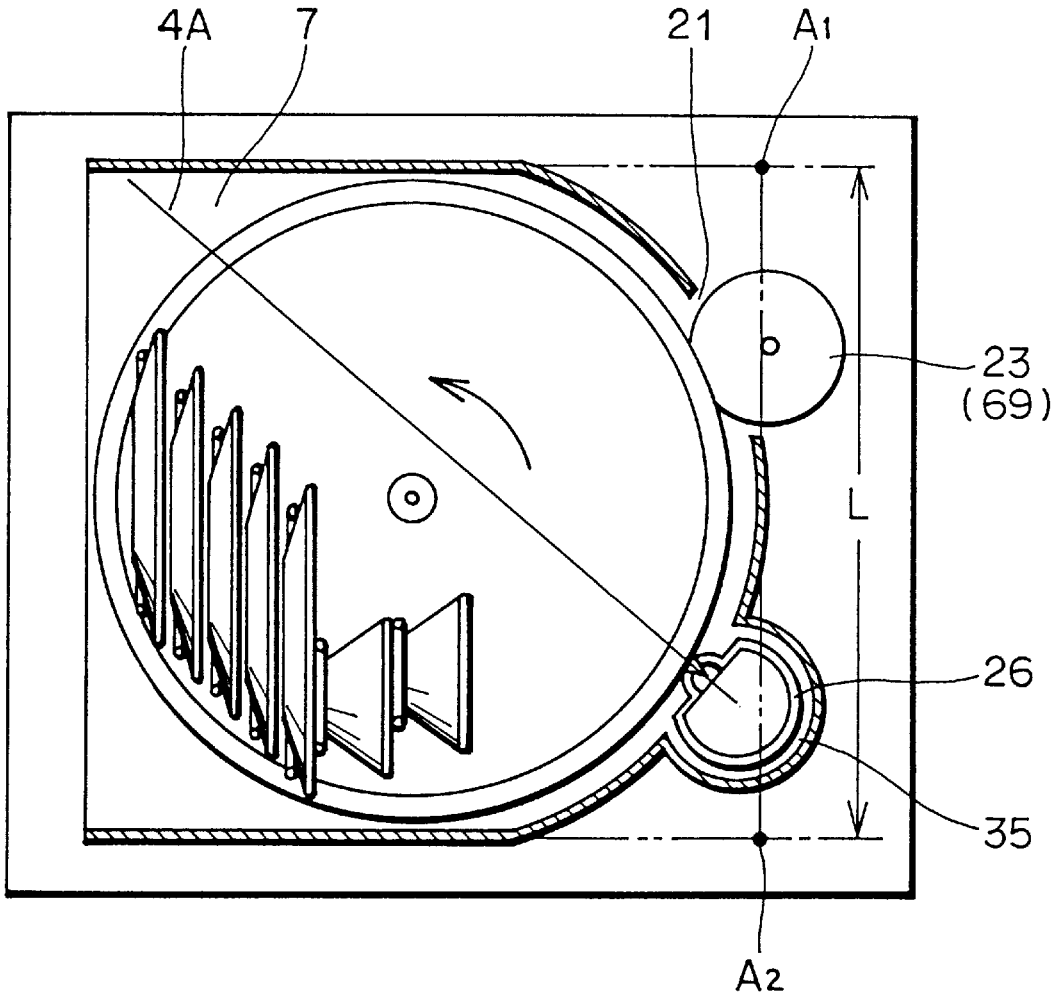
FIG. 6 is a horizontal cross section showing schematic structure of the dishwasher shown in FIG. 1.

Referring to FIGS. 3, 5 and 6, dishwasher 1 includes a washing chamber member 40. A member forming a bottom portion of washing chamber 7 of washing chamber member 40 has a water tank 12 formed at a position on the side of door 4. Water tank 12 is for reserving washing water or rinsing water by a prescribed amount so as to smoothly supply the washing water of rinsing water to the washing nozzle, which will be described later. On water tank 12, a washing filter 19 formed of metal and having a plurality of punching holes allowing passage of water but not garbage is placed on water tank 12. Water tank 12 has a bottom one step lower than the bottom surface of washing chamber 7, and occupies about one half the area on the front side of the bottom portion of washing chamber 7. Referring to FIG. 6, a W-shaped sheathed heater 13 is provided for improving washing performance by heating washing water and rinsing water is provided in water tank 12.

Since water is fed to the dishwasher, much attention should be paid to water proofing. Especially, the printed board for control must be sufficiently insulated and water proofed. Conventionally, it has been necessary to take sufficient measures for water proof and insulation of the printed board for control. In the dishwasher in accordance with the present invention, referring to FIG. 5, the operation panel 3 and a printed board 91 are separated, and control box 111 containing the printed board 91 on which the control microcomputer is mounted is arranged near the rear ceiling in the cabinet behind the washing chamber 7 where contact with water is less likely. Only the operation panel 3 is arranged below the front surface of the dishwasher. The printed board 91 remains dry and the malfunction rate can be lowered. Further, safety of the apparatus can be improved. Various keys arranged on operation panel 3 have low operational voltages and therefore even when they got wet, the likelihood of serious damage the equipment or user is reduced. Further, water proofing of operation panel 3 only is easy, thereby facilitating processing and assembly.

Referring to FIG. 5, on the inner ceiling surface of washing chamber member 40, a silk printed film 41 is adhered. By the capillary action of net pattern of silk printing, hydrophilicity of the inner ceiling surface of washing chamber member 40 is improved. Water adhered on the inner ceiling surface of washing chamber member 40 does not form a large drop but flows down on the sidewall surface of the washing chamber 7. Adhesion of drops can further be reduced by adhering the silk printed film 41 also on the sidewall surfaces of washing chamber 7.

Referring to FIG. 6, deep on the right side surface of washing chamber 7, there is provided a washing nozzle 26 having a plurality of jet openings formed along the vertical direction facing the left side front corner of the washing chamber. As is shown by the line 4A, the washing water is jet toward the corner defined by the front door 4 and the washing chamber 7 approximately diagonally of the washing chamber 7 from washing nozzle 26. When washing water is jet out from the washing nozzle 26 without placing objects or dishes on the dish washing basket 8, the jet water collides the wall surface of washing chamber 7, causing crushing sound. If the water is jet out at an angle at which the washing water collides orthogonally against the wall surface, considerable sound is generated. In the present embodiment, the washing water is jet diagonally in the washing chamber 7, and therefore the water does not orthogonally collide against the wall surface. Therefore, sound and vibration can be suppressed.

The direction of jetting is displaced from the center of rotation of dish washing basket 8 and is consistent with the direction of rotation of the dish washing basket 8 as shown in FIG. 6. The water from washing nozzle 26 hits the objects to be washed, generating a force to rotate the objects in the direction of rotation of the dish washing basket 8. This force assists the rotating force of driving motor 22, and therefore power consumption of driving motor 22 can be reduced, allowing use of a small driving motor 22. This reduces cost.

In the present embodiment, as shown in FIGS. 1, 2 and 5, the front edge of the upper wall 42 of front opening of washing chamber 7 is recessed toward immediately above the rotary axis of dish washing basket 8. Front edges of both sidewalls 43 are inclined linearly backward. Accordingly, when objects to be washed are mounted in two stages using an additional basket which will be described later in the dish washing basket 8, the objects can be readily put in or taken out from the upper basket. Damage caused when a large dish or the like hits the front edge on the ceiling surface of washing chamber 7 can be prevented.

Figure 7:
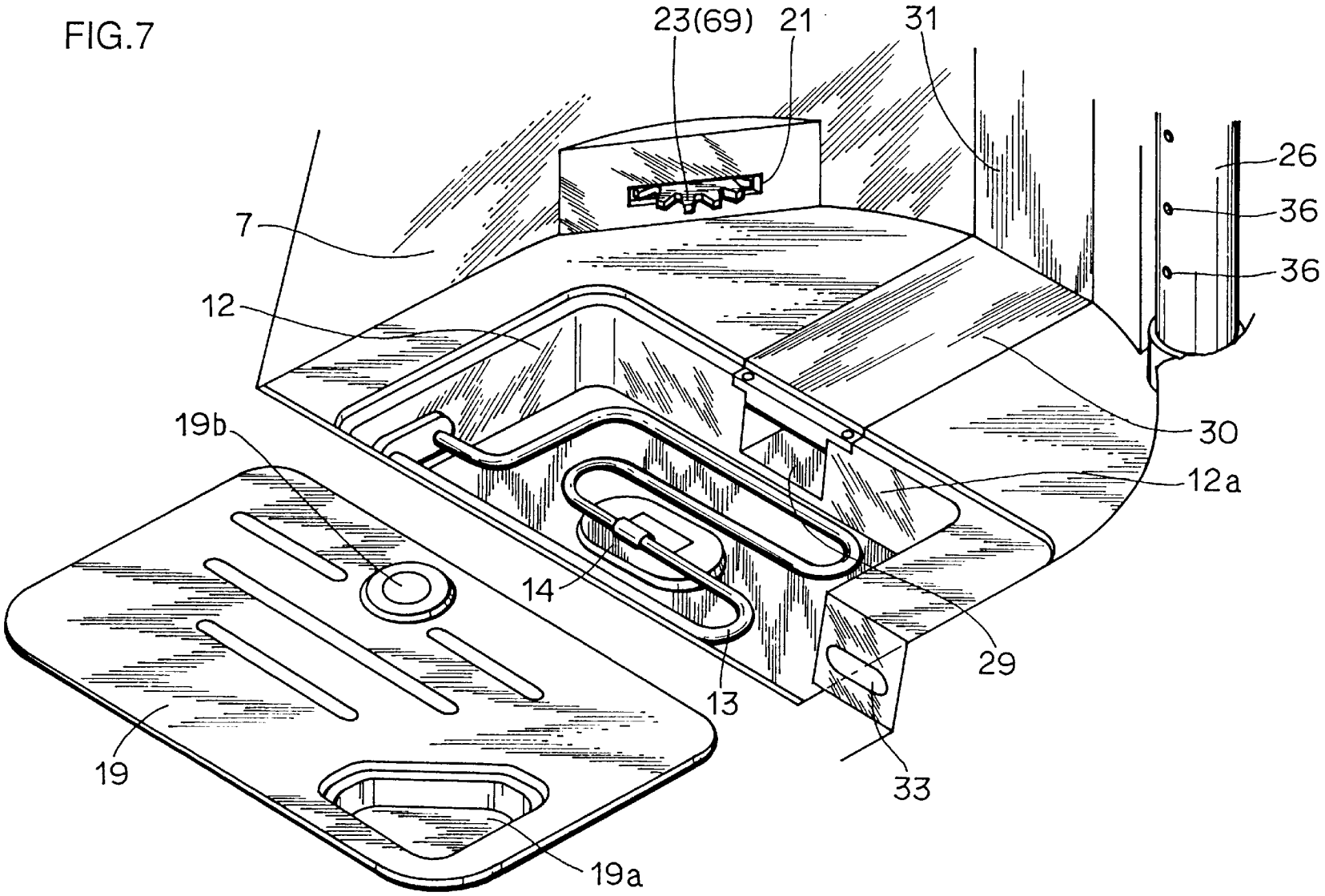
FIG. 7 is a perspective view of a main portion in the washing chamber.

Referring to FIGS. 3, 6 and 7, approximately at the deep left corner of washing chamber 7, a rectangular opening 21 is formed. Through this opening 21, part of the mechanism for driving dish washing basket 8 faces the washing chamber 7. Referring to FIG. 3, the driving mechanism for the dish washing basket 8 includes a driving motor 22 arranged on the left side behind the body cabinet, and a power transmitting portion 69 coupled to driving motor 22. Details of the power transmitting portion 69 will be described later. The power transmitting portion 69 includes a rotary gear 23, and part of which protrudes from opening 21 into washing chamber 7 as shown in FIGS. 5 and 7, engages with the gear 9 (see FIG. 2) below the dish washing basket 8 and rotates the dish washing basket 8.

The deep side corner of washing chamber 7 will be described with reference to FIG. 6. Extensions of two side surfaces of washing chamber 7 and the rear surface of washing chamber 7 are shown as lines in FIG. 6. These lines have two intersections A1 and A2. The intersection on the left side viewed from the front side of the dishwasher is denoted by A1 and the left intersection is denoted by A2. Distance between intersections A1 and A2 is represented by L. A circle having the radius of L2 can be drawn with intersection A1 or A2 being the center in body cabinet. The area in the circle will be referred to as the deep side corner.

Referring to FIGS. 3 and 7, an air inlet 29 is formed on a sidewall 12*a* of water tank 12. The air duct from air blower 28 is communicated with the air inlet 29 through the rear surface of the bottom surface of washing chamber 7 from the rear surface of washing chamber 7. At the bottom portion and at the deep central portion of washing chamber 7, a bottom wall 30 and a sidewall 31 partitioning the air duct and the washing chamber 7 are provided. The dishwasher 1 further includes a heat sensing plate 14 provided at a position to be in contact with the linear portion of a heater 13, and a keep plate 14*a* welded in advance to heat sensing plate 14 for fixing heater 13.

Figure 8:
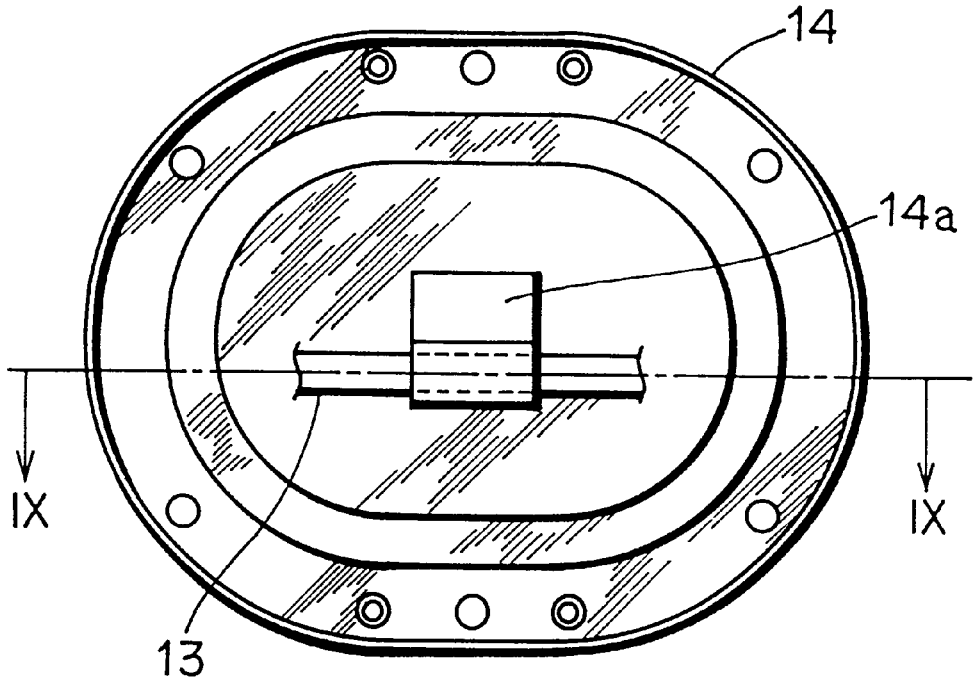
FIG. 8 is a plan view of a heat sensing plate.
Figure 9:
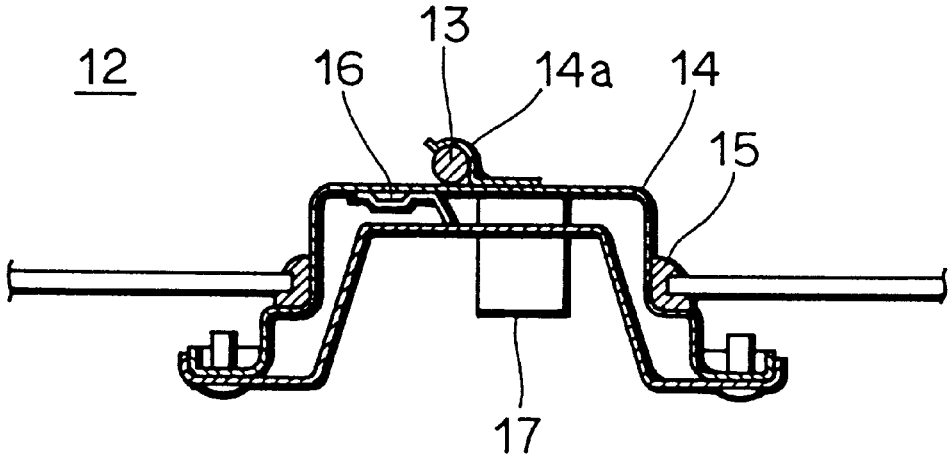
FIG. 9 is a cross section of a side showing manner of attachment of the heat sensing plate.

Heat sensing plate 14 is a metal plate formed of stainless steel, for example, having a convex shape such as shown in FIGS. 8 and 9. Heat sensing plate 14 is fixed at the bottom portion of water tank 12 with a packing 15 interposed, such that the convex portion thereof protrudes into the water tank 12. Especially referring to FIG. 9, dishwasher 1 has heat sensing plate 14 protruding from the bottom portion of water tank 12, and heater 13 is arranged to be in tight contact with the top surface thereof. When the water level becomes lower than heater 13, the heater idles. However, the temperature of heater 13 can be quickly detected by heat sensing plate 14.

Referring to FIGS. 5 and 7, on the front wide corner of washing filter 19, a garbage receiving portion 19*a* is provided, which has its bottom surface made lower than the top surface of washing filter 19. A basket for receiving garbage is attached to garbage receiving portion 19*a*. The user can take out the basket and dispose the garbage received by the basket. On the upper surface at the deep central portion of washing filter 19, a turntable support portion 19*b* for supporting rotary axis 20 (see FIG. 5) of dish washing basket 8 is provided. Turntable support portion 19*b* is reinforced as it is coupled by welding to some of the punching holes of washing filter 19. Turntable support portion 19 is provided protruding upward from the top surface of washing filter 19, and at the upper central portion of the convex portion, it has a hemispherical concave portion. Lower end of the rotary axis 20 of dish washing basket 8 is fit in the concave portion. Since turntable support portion 19 has a concave portion at its center, the rotary axis 20 of dish washing basket 8 can be readily attached to the turntable support portion 19 with its central axis positioned correctly.

Other portions of rotary gear 23 are contained in a gear housing portion 24 integrally molded with washing chamber member 40, of resin. At an upper portion of gear housing portion 24, a water inlet 25 is provided, to which service water for washing is supplied. The washing water passes through gear housing portion 24 and fed through opening 21 to washing chamber 7.

Opening 21 is arranged lower than the lowermost one of the jet openings of washing nozzle 26. Since opening 21 for water feeding is positioned at a lower portion of washing chamber 7, the washing water falls from the water inlet to the bottom surface of washing chamber 7 only by a short distance, and therefore sound of water can be suppressed.

Opening 21 provided for transmitting power for rotating dish washing basket 8 also serves as the water inlet. It is not necessary to provide the water inlet separately from opening 21, and therefore area of the wall surface of washing chamber 7 can be utilized. Further, the number of parts for providing the water inlet can be reduced and the cost of the dishwasher can be reduced.

The structure further provides the following effects. Rotary gear 23 always has its part facing washing chamber 7. Therefore, at the time of washing, garbage or waste may adhere to the rotary gear 23. However, since opening 21 also serves as water inlet, washing water always flows around rotary gear 23 when water is fed, washing away the deposited garbage or waste. Since rotary gear 23 is always washed and kept clean, rotary gear 23 is well maintained, ensuring smooth rotation of dish washing basket 8.

Referring to FIG. 7, air inlet 29 is arranged below approximately the center of the washing chamber 7 and opposes to heater 13. Air inlet 29 is formed such that the center is positioned on the same plane as heater 13. The air introduced from air duct through air inlet 29 into washing chamber 7 directly contacts heater 13, and the air absorbs heat from heater 13 efficiently. Further, water adhered on the heater 13 after draining can be dried quickly, insulation of heater 13 is well kept and the life of heater 13 can be made longer.

Air inlet 29 feeds air to the upper portion of water tank 12. At the upper portion of water tank 12, the dish washing basket 8 which is rotated by rotary gear 23 is positioned. The air for drying is fed from below with respect to that portion which corresponds to the radius of dish washing basket 8. Object to be dried placed over the central portion to the peripheral portion of dish washing basket 8 can be uniformly and quickly dried.

Air inlet 29 is connected with water tank 12. When water tank 12 is filled with washing water, the washing water is reserved also at the bottom portion of the air duct. However, water level of water tank 12 is as low as about the bottom surface of washing chamber 7. Therefore, water does not reach the air blower 28 positioned higher than the bottom surface of washing chamber 7. When washing water is drained from water tank 12, water is also drained from air duct, and only the air passes through the duct.

Referring to FIG. 9, dishwasher 1 includes a thermistor 16 and a thermocut 17 as heat sensing elements, attached on the rear surface of heat sensing plate 14 by means of an attaching plate 18. Heat sensing portions of thermistor 16 and thermocut 17 are tightly attached on heat sensing plate 14. Thermistor 16 is used for normal operation control such as control of water temperature and drying air temperature. Thermistor 16 senses temperature well as it is arranged on the rear surface of heater 13, enabling highly precise temperature control.

Thermocut 17 is arranged further from heater 13 as compared with thermistor 16. In other words, the thermocut 17 has lower sensitivity to temperature than thermistor 16. This is because thermocut 17 is provided to sense temperature in case of a malfunction, such as idle heating of heater 13. Since it is placed far from heater 13, it can sense temperature even when thermistor 16 fails to detect temperature by some malfunction.

Again referring to FIGS. 3, 5 and 6, dishwasher 1 further includes a circulation pump 32 placed at a lower corner outside washing chamber 7 in body cabinet, for supplying with pressure washing water and rinsing water in water tank 12 to washing nozzle 26, and for feeding waste water after washing to a drain outlet connected to drainage. Referring to FIG. 7, water absorbing inlet 33 of circulation pump 32 is provided at the bottom portion of water tank 12. Water absorbing inlet 33 is integrally molded with washing chamber member 40. Water absorbing inlet 33 is near the bottom plate of cabinet as shown in FIG. 3, and it is coupled to circulation pump 32 by means of a flat hose 34 having a flat shape. As a flat hose 34 is used, narrow space between the washing chamber and the bottom plate is well utilized and the dishwasher can be made compact. Further, sucking up of air from the water absorbing inlet 33 can be prevented.

Figure 11:
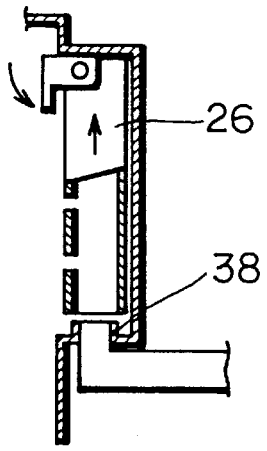
FIG. 11 is a cross section of a main portion illustrating an attachment/detachment of the washing nozzle.

Referring to FIGS. 5 and 6, at a concave portion 35 at the deep right corner of washing chamber 7, a washing pipe 38 is provided. To washing pipe 38, washing nozzle 26 having a plurality of jet outlets in the vertical direction is detachably attached. Washing pipe 38 is coupled to circulation pump 32 through flat hose 34. Referring to FIG. 5, the lowermost one of the jet outlets 36 is placed higher than the rotary gear 23. At an upper end portion of washing nozzle 26, a rotatable attachment/detachment lever 37 is provided. By rotating lever 37 as shown in FIG. 11, washing nozzle 26 can be moved upward to be removed from washing pipe 38.

Since washing nozzle 26 can be removed from washing pipe 38, the portions near the concave portion 35 at the deep right corner of washing chamber 7 and washing nozzle 26 can be cleaned easily.

A cleaning key designating cleaning of washing chamber 7 is provided on operation panel 3 (not shown). This cleaning is performed by jetting washing water to washing chamber 7 from the upper opening of washing pipe 38 when washing nozzle 26 is removed. Washing nozzle 26 is removed from washing pipe 38, the door 4 is closed and the cleaning key is operated. In response to this operation, washing water is jet out from the opening on the side of washing pipe 38, and washing chamber 7 can be washed.

Figure 12:
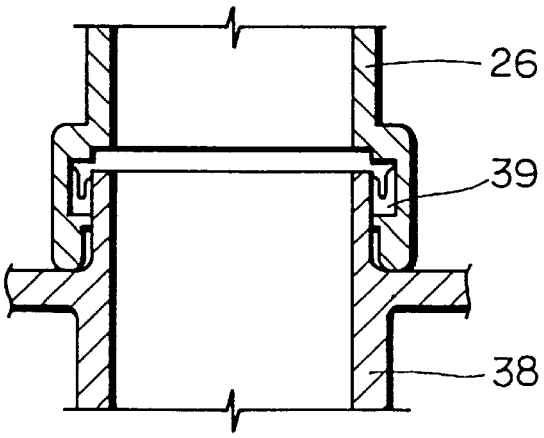
FIG. 12 is a cross section of a connection between the washing nozzle and a water feed pipe.

At a connection between the lower portion of washing nozzle 26 and washing pipe 38, a packing 39 having a U-shaped cross section is interposed as shown in FIG. 12, for improved sealing. Leakage from a gap at the connection between washing nozzle 26 and washing pipe 38 can be prevented.

Figure 13:
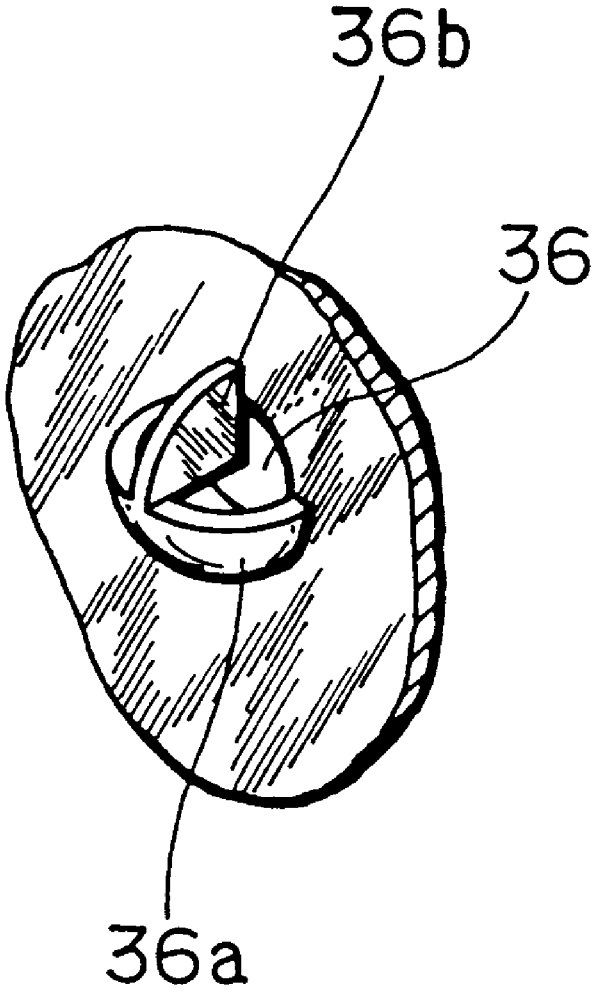
FIG. 13 shows, in enlargement, jet opening of the washing nozzle.

As already described, washing nozzle 26 has a plurality of jet outlets 36. At a lower portion of the highest one of jet outlets 36, a quarter spherical shell guide **36*a* opening upward is provided as shown in FIG. 13, so that washing water can be jet out toward the inner ceiling of washing chamber member 40. At the center of the jet outlet 36, a vertical rib 36*b* is provided as shown in FIG. 13. The vertical rib 36*b* disperses jet of washing water to expand range of jetting, enhancing the effect of washing of the inner surface of washing chamber member 40 and the inner surface of door 4**.

Figure 14:
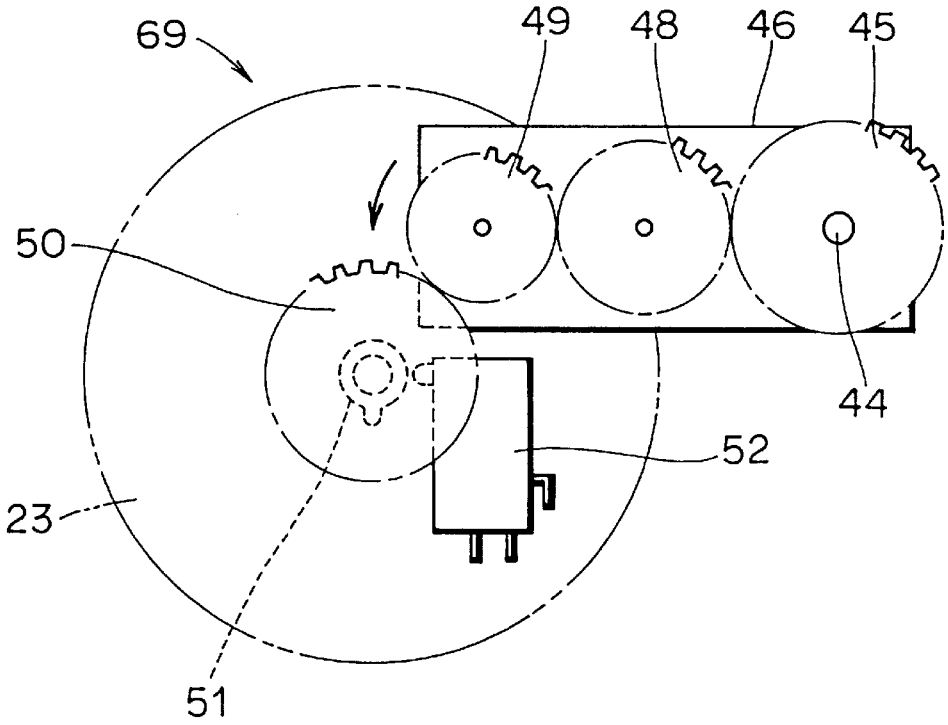
FIG. 14 is a plan view schematically showing a mechanism for rotatably driving the dish washing basket.
Figure 15:
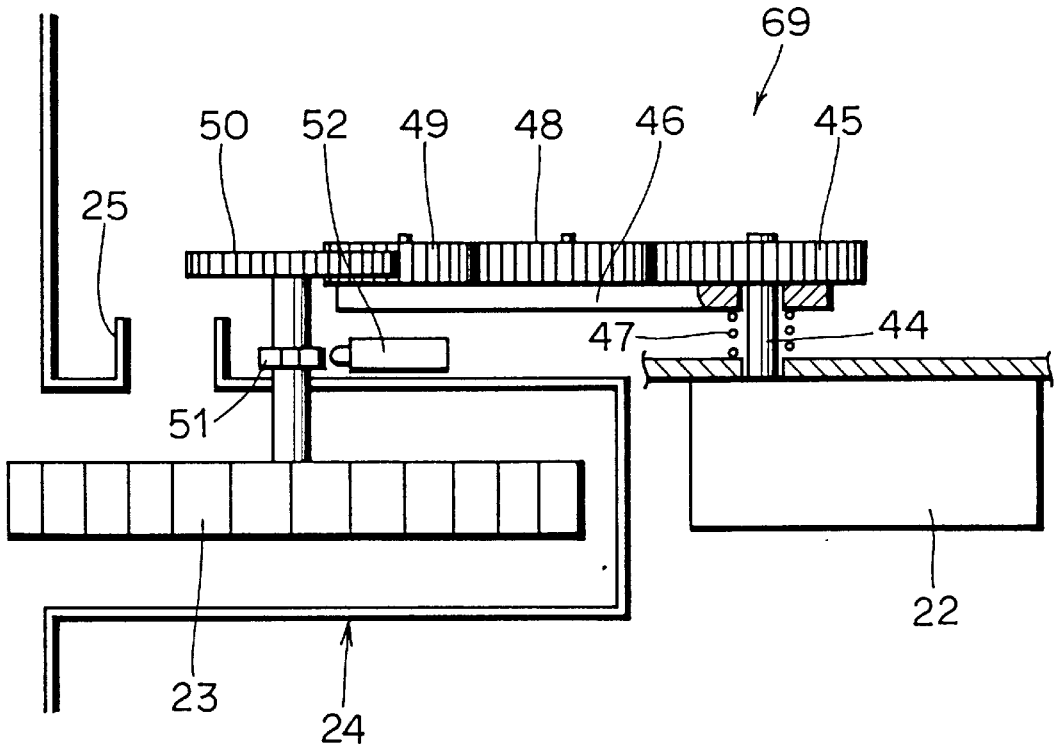
FIG. 15 is a side view schematically showing a mechanism for rotatably driving the dish washing basket.

Referring to FIGS. 14 and 15, the mechanism for rotating dish washing basket 8 includes a driving motor 22 having a prescribed direction of rotation and having a driving shaft 44, a driving gear 45 provided at the tip end of driving shaft 44, a swing lever 46 attached swingable with respect to driving shaft 44 between driving gear 45 and driving motor 22 of driving shaft 44, and a coil spring 47 inserted between swing lever 46 and driving motor 22 around driving shaft 44 for pressing swing lever 46 against driving gear 45.

Figure 10:
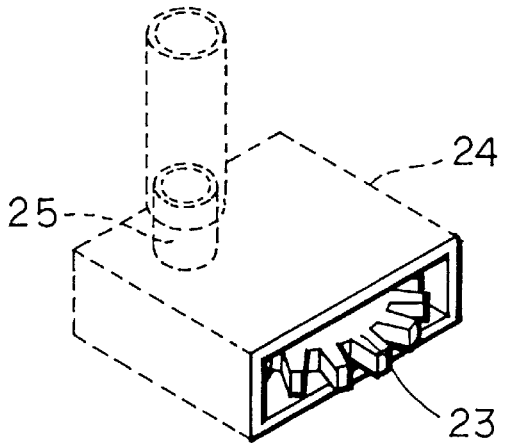
FIG. 10 is a perspective view of a rotary gear portion.

The mechanism for rotating the dish washing basket 8 further includes a first transmission gear 48 rotatably supported at the upper surface of swing lever 46 to be engaged with driving gear 45, a second transmission gear 49 rotatably supported on the upper surface of swing lever 46 to be engaged with the first transmission gear 48, and an output gear 50 to be engaged with the second transmission gear 49. The first and second transmission gears 48 and 49 are planet gears arranged on swing lever 46. Output gear 50 is coaxial with gear 23 described with reference to FIG. 10, and it rotates together with rotary gear 23. The mechanism for rotating dish washing basket 8 further includes a cum 51 provided coaxially with rotary gear 23 and rotating in the same period as rotary gear 23, and a microswitch 52 provided on the rotary track of cum 51. Microswitch 52 has its contact opened/closed as rotary gear 23 rotates, so that rotation of dish washing basket 8 is detected. Microswitch 52 is a part of the control system for dishwasher. The structure of the control system will be described later.

When driving motor 22 rotates, driving gear 45 also rotates, and swing lever 46 swings in the same direction as the direction of rotation of driving motor 22 because of friction force with the driving gear 45 (the direction shown by the allow in FIG. 14). Then the second transmission gear 49 comes to be engaged with output gear 50. The rotating force of driving motor 22 is transmitted through driving gear 45 and first and second transmission gears 48 and 49 to output gear 50, and the rotation gear 23 is rotated. Thus, dish washing basket 8 having gear 9 engaging with rotary gear 23 rotates.

When driving motor 22 is stopped, the force rotating in the direction shown by the arrow in FIG. 14 is not applied to swing lever 46. Only the pressing force of coil spring 47 acts on swing lever 46.

Driving shaft 44 of driving motor 2 freely rotates in either direction. When rotary gear 23 is moved manually, a force in a direction away from output gear 50 acts on swing lever 46. Accordingly, swing lever 46 swings in a direction away from output gear 50, and therefore output gear 50 is disengaged from the second transmission gear 49. Therefore, rotary gear 23 can be freely rotated manually.

When the dish washing basket 8 is to be attached to dishwasher 1 or removed from dishwasher 1, driving motor 22 of dishwasher 1 is stopped and door 4 is opened. As driving motor 22 is stopped, rotary gear 23 which engages with gear 9 of dish washing basket 8 rotates easily.

Therefore, when dish washing basket is attached, rotary gear 23 can be readily engaged with gear 9. From the same reason, the dish washing basket can be readily taken out. After the dish washing basket 8 is attached to dishwasher 1 and object or dishes are placed on dish washing basket 8, dish washing basket 8 can be freely rotated. Therefore, the object to be washed or dishes can be placed at an arbitrary position on the dish washing basket 8.

The driving mechanism described above is arranged at a corner outside washing chamber 7 of body cabinet 117, and therefore the corner space can be well utilized, and the dishwasher can be made compact. Since washing nozzle is placed at the corner opposite to the driving mechanism deep in the washing chamber 7, the dishwasher can further be made smaller.

Referring to FIGS. 14 and 15, by the rotation of cum 51, contact of microswitch 52 is opened/closed. In other words, the microswitch turns on/off. As microswitch 52 turns on/off, a pulse signal is applied to the microcomputer. The microcomputer for control determines whether dish washing basket 8 is rotating or not in accordance with whether the pulse is detected or not.

Figure 16:
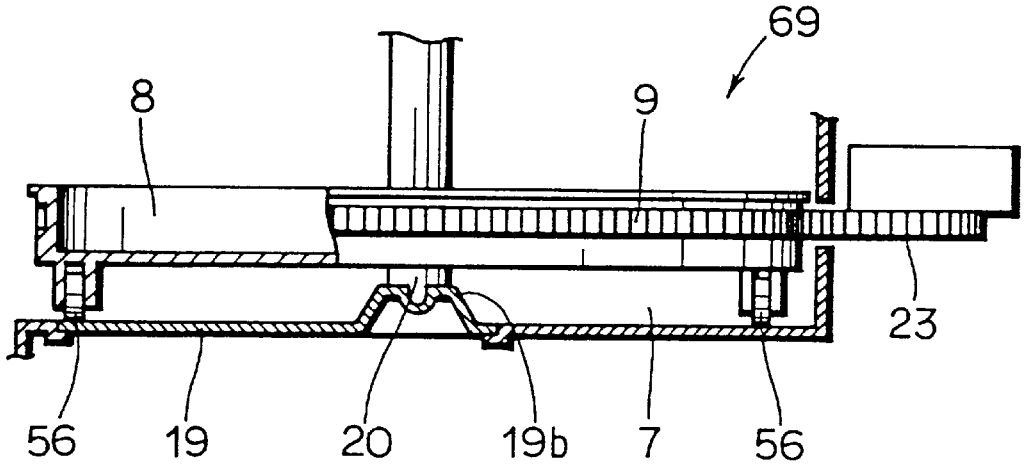
FIG. 16 is a cross section showing a lower portion of the dish washing basket on the washing filter.

Referring to FIG. 16, dish washing basket 8 includes four rollers 56 provided on its rear surface, for stably rotating dish washing basket 8. These four rollers 56 ensures stable rotation of dish washing basket 8 even when heavy objects of glass or stoneware are placed on dish washing basket 8 or even when the object to be washed are biased on dish washing basket 8. Material of roller 56 may be selected taking into consideration the strength, smoothness, water resistance and heat resistance. Teflon resin (trademark) may be used, for example.

Rollers 56 pass over the punching holes of washing filter 19 and the bottom portion of washing chamber 7 as dish washing basket 8 rotates. To enable smooth movement of roller 56, the bottom portion of washing chamber 7 is made flash with the upper surface of washing filter 19.

When dish washing basket 8 is taken out from washing chamber 7 and placed on a table, for example, dish washing basket 8 should be stably maintained horizontal. For this purpose, at least three, and preferably four or more rollers 56 are provided. The length of rotary axis 20 is selected such that the lower end portion thereof is positioned upper than the lower end of roller 56 so that lower ends of rollers 56 are brought into contact with the surface of the table or the like before the rotary axis 20 of dish washing basket 8. Meanwhile, when dish washing basket 8 is attached to washing chamber 7, dish washing basket 8 should be stabilized. For this purpose, the height of turntable support portion 19*b* of washing filter 19 shown in FIG. 16 is made equal to the difference in height between the lower end of roller 56 and the lower end of rotary axis of dish washing basket 8.

Weights of the object placed on dish washing basket 8 are concentrated to the rotary axis 20 at the central portion of the rear surface of dish washing basket 8. Rotary axis 20 must have some strength. Therefore, rotary axis 20 is formed of a metal pipe, and screwed on the rear surface of dish washing basket 8 by means of a vis.

Figure 17:
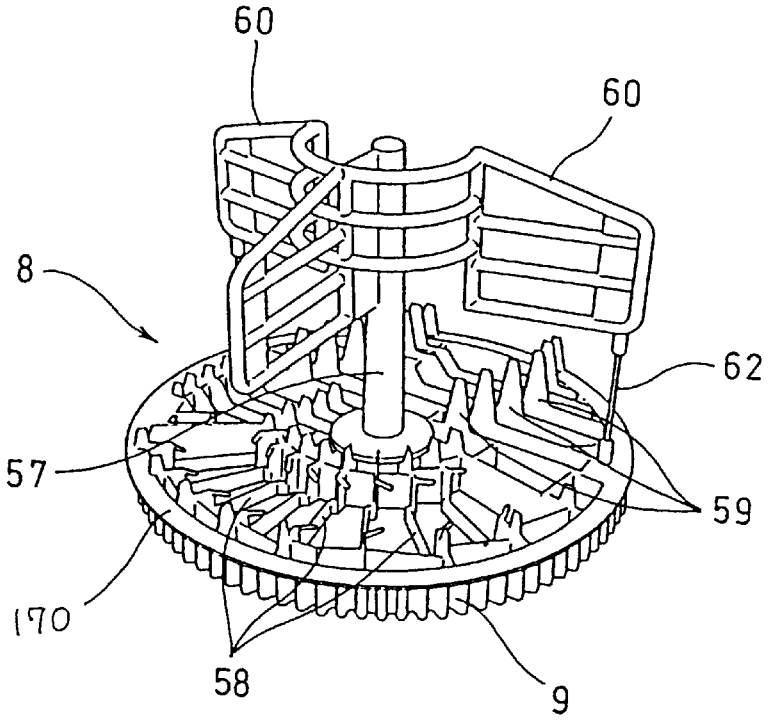
FIG. 17 is a perspective view of the dish washing basket.

Referring to FIG. 17, dish washing basket 8 formed of resin includes an approximately circular bottom portion 170, a vertical columnar pole 57 provided at the center of bottom portion 170, and a plurality of support bars 60 for supporting an additional basket for containing smaller objects to be washed, provided projecting outward from the center to the upper end in the height direction of pole 57. Bottom portion 170 includes a plurality of ribs 58 formed radially from the middle of the lower outer periphery of pole 57, a plurality of mutually parallel ribs 59 formed on the opposite side of ribs 58, and a metal pole 62 supporting support bar 60 provided between a lower tip end portion of support bar 60 and an annular portion formed by the ribs 58 and 59. Outer peripheries of ribs 58 and 59 are connected, forming an annulus. Between ribs 58 and 59, objects to be washed such as dishes are placed. Support bar 60 also has a function of supporting a large object.

Washing nozzle 26 jets water approximately toward the center of washing chamber 7. When objects are placed radially in dish washing basket 8, the water goes from the outer periphery toward the center of the surface of the objects. Therefore, the objects can be washed efficiently and uniformly. When the objects are to be dried, the air passes uniformly through the spaces between the objects, allowing quick and satisfactory drying.

Figure 18:
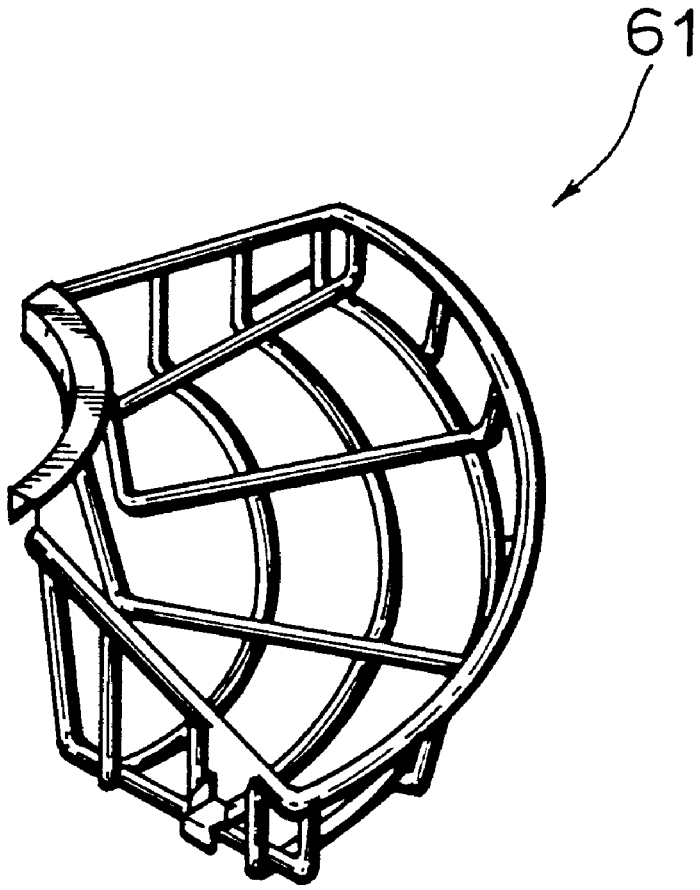
FIG. 18 is a perspective view of an additional basket for small articles.
Figure 19:
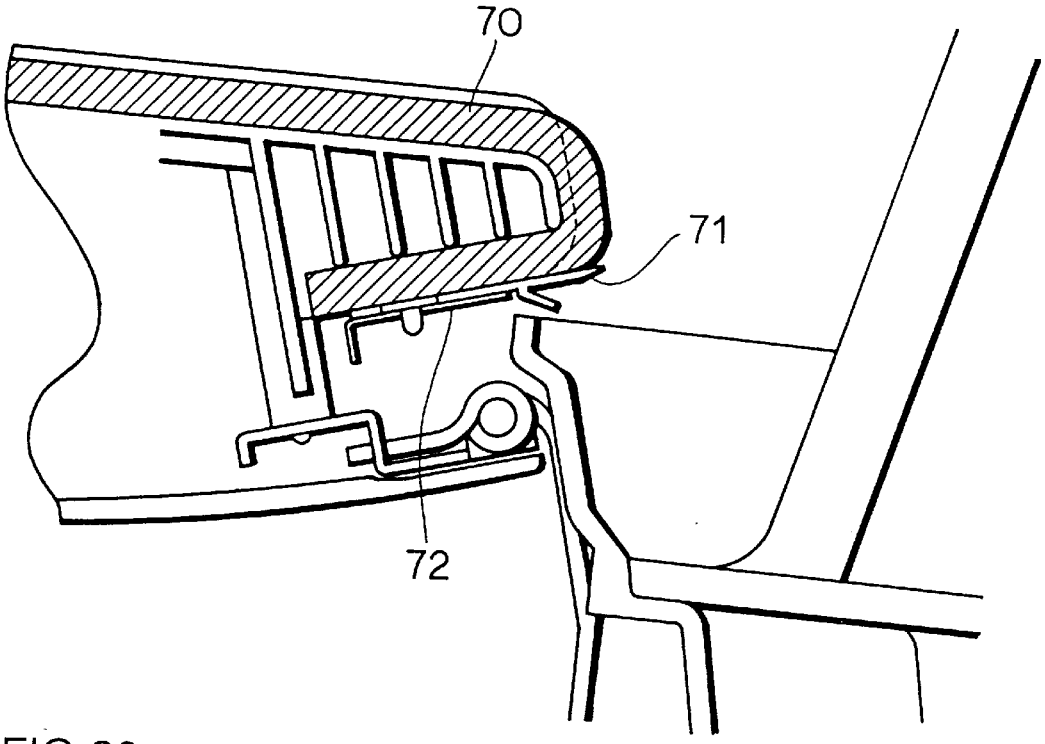
FIG. 19 is a side view of a hinge portion with the door opened.
Figure 20:
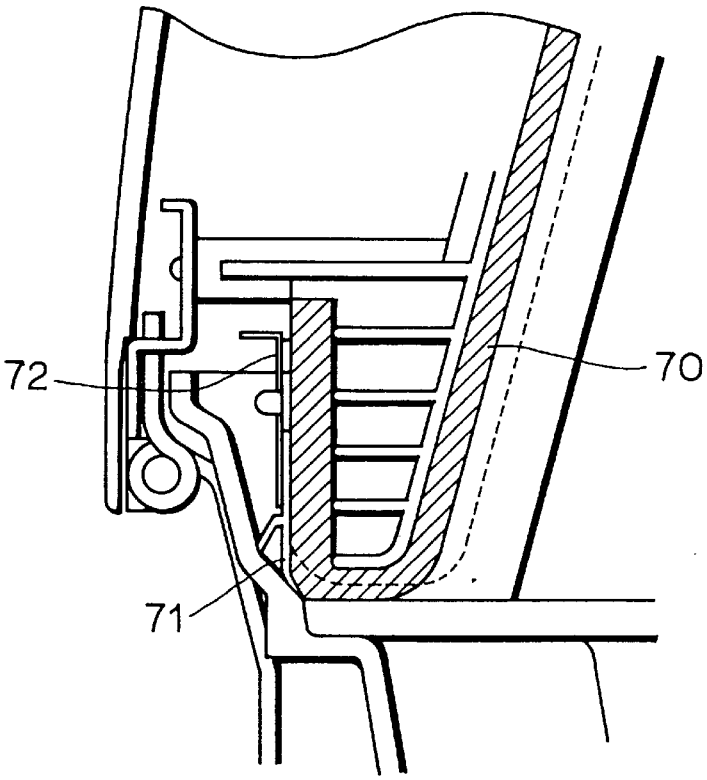
FIG. 20 is a side view of the hinge portion with the door closed.

Referring to FIG. 18, the additional basket for smaller objects 61 has a fan-like shape. Addition basket 61 is supported with its opposing ends supported by adjacent support bars 60. The height of basket 61 can be adjusted by attaching its on support bars 60 of different height. The height of attachment of basket 61 can be adjusted in accordance with the size of the object placed on dish washing basket 8, so that the objects are stabilized.

Support bars 60 and basket 61 are formed by resin molding, and they do not have high strength. When basket 61 is attached to support bar 60 and an object is placed on basket 61, support bars 60 may bent by the weight of the object. Metal pole 62 is provided to prevent bending of support bar 60. Because of metal pole 62, basket 61 can be stably held by support bars 60. The portion of support bar 60 which holds basket 61 becomes higher as it goes away from pole 57. Meanwhile, the bottom surface of basket 61 becomes deeper as it comes close to pole 57, as shown in FIG. 18. Therefore, when basket 61 is held by support bars 60, the bottom surface of the basket is inclined toward pole 57. When dish washing basket 8 rotates, centrifugal force acts on the objects to be washed in basket 61. However, because of the inclination of the bottom surface of basket 61, the object does not possibly move outward, and hence the dish washing basket 8 can be rotated stably.

Figure 27:
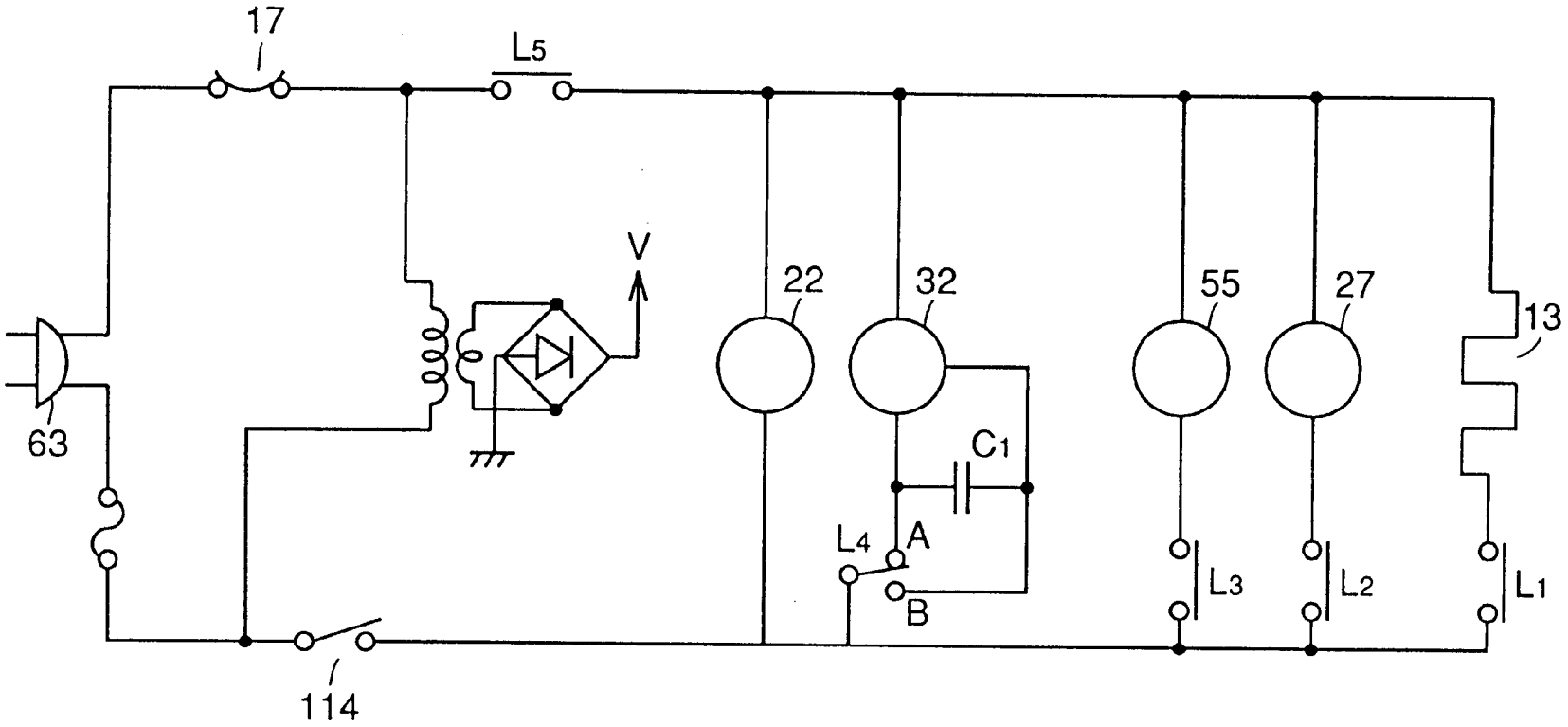
FIG. 27 is a circuit diagram of the driving system of the dishwasher.

Referring to FIG. 27, the circuit of the driving system of the dishwasher in accordance with the present embodiment includes a receptacle 63 connected to an AC power source, a thermocut 17 connected in series with receptacle 63, a relay L5, and a door switch 114 for detecting door lock. Further, the circuit includes a water feed valve 55, a driving motor 22, a circulation pump 32, an air blower motor 27 and a sheathed heater 13 connected parallel to receptacle 63 through thermocut 17 and relay L5. The circuit further includes a relay L4 for controlling circulation pump 32, a relay L3 for controlling water feed valve 55, a relay L2 for controlling air blower motor 27, and a relay L1 for controlling a heater 8. In this embodiment, relay L5 is provided in series with receptacle 63. However, in order to control drive motor 22, the relay L5 may be connected in series with driving motor 22 and parallel to receptacle 63. The position of thermocut 17 is not limited to the position shown in FIG. 27. For example, thermocut 17 may be positioned in series with sheathed heater 13 and parallel to receptacle 13. The circuit elements shown in FIG. 27 are controlled by a microcomputer 53, which will be described later. The circuit for the driving system includes a low voltage transformer and a voltage stepped down from the low voltage transformer is rectified by a rectifier circuit and supplied as a voltage V to various electronic parts such as microcomputer 53.

Figure 28:
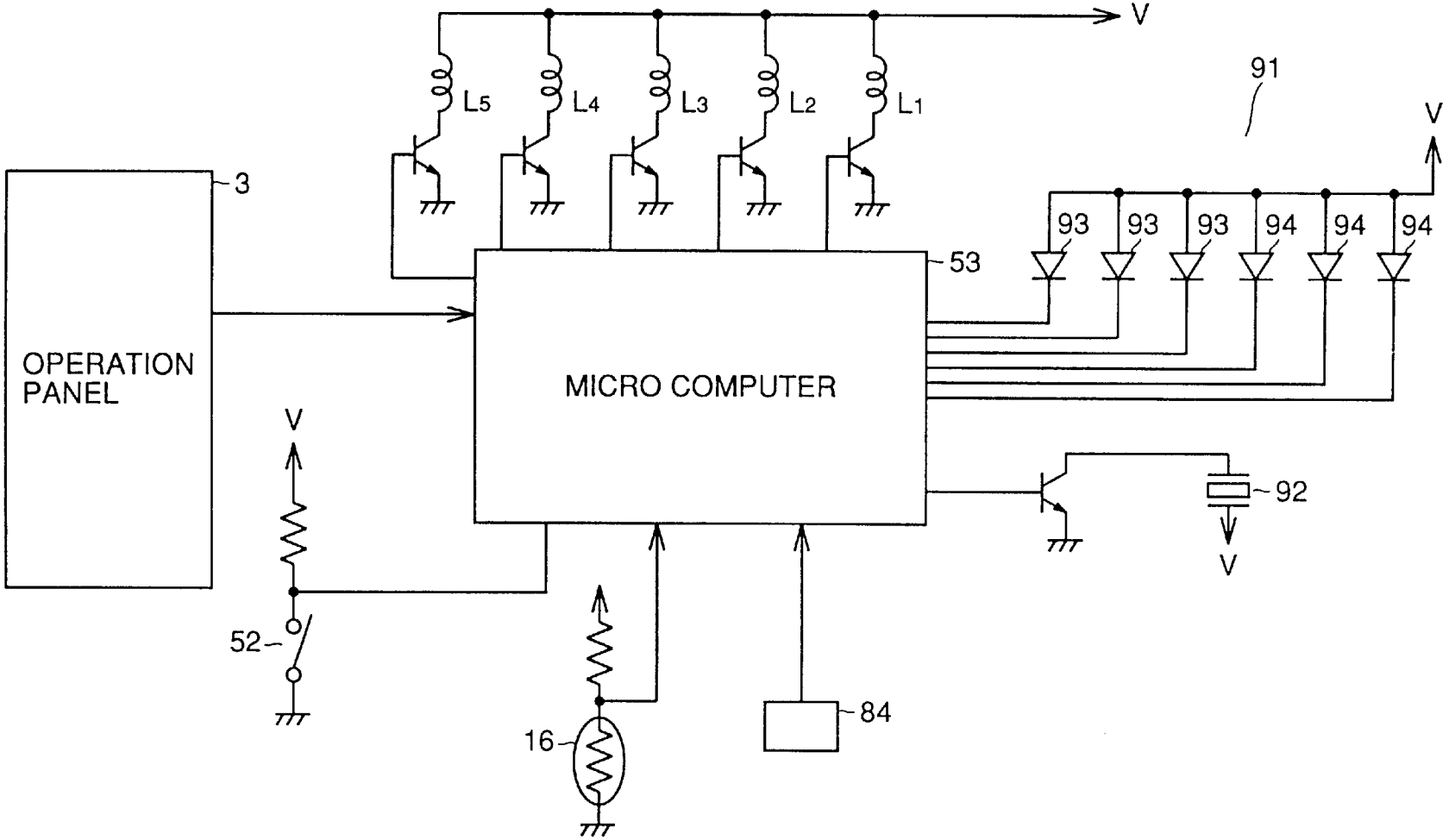
FIG. 28 is a circuit diagram of a control system of the dishwasher.

Referring to FIG. 28, the control circuit of the dishwasher in accordance with the present embodiment includes a microcomputer 53 for controlling respective circuit elements shown in FIG. 27 and various keys, which will be described later, and it includes an operation panel 3 connected to microcomputer 53, a washing condition indicating portion 94 including three LEDs controlled by microcomputer 53, a drying condition indicating portion 93 including three LEDs controlled by microcomputer 53, a resistance and a microswitch 52 connected in series between a DC power source and a ground for detecting rotation of dish washing basket 8 and for applying a detection signal to microcomputer 53, a thermistor 16 connected in series between the DC power source and a ground, for detecting temperature of water and applying detection signal to microcomputer 53, a water level sensor 54 for detecting water level of water tank 12 and applying a detection signal to microcomputer 53, a float switch 84 for detecting leakage of a water pool portion, which will be described later, and for applying a detection signal to microcomputer 53, and a buzzer 93 connected to microcomputer 53 for ringing an alarm sound.

Figure 29:
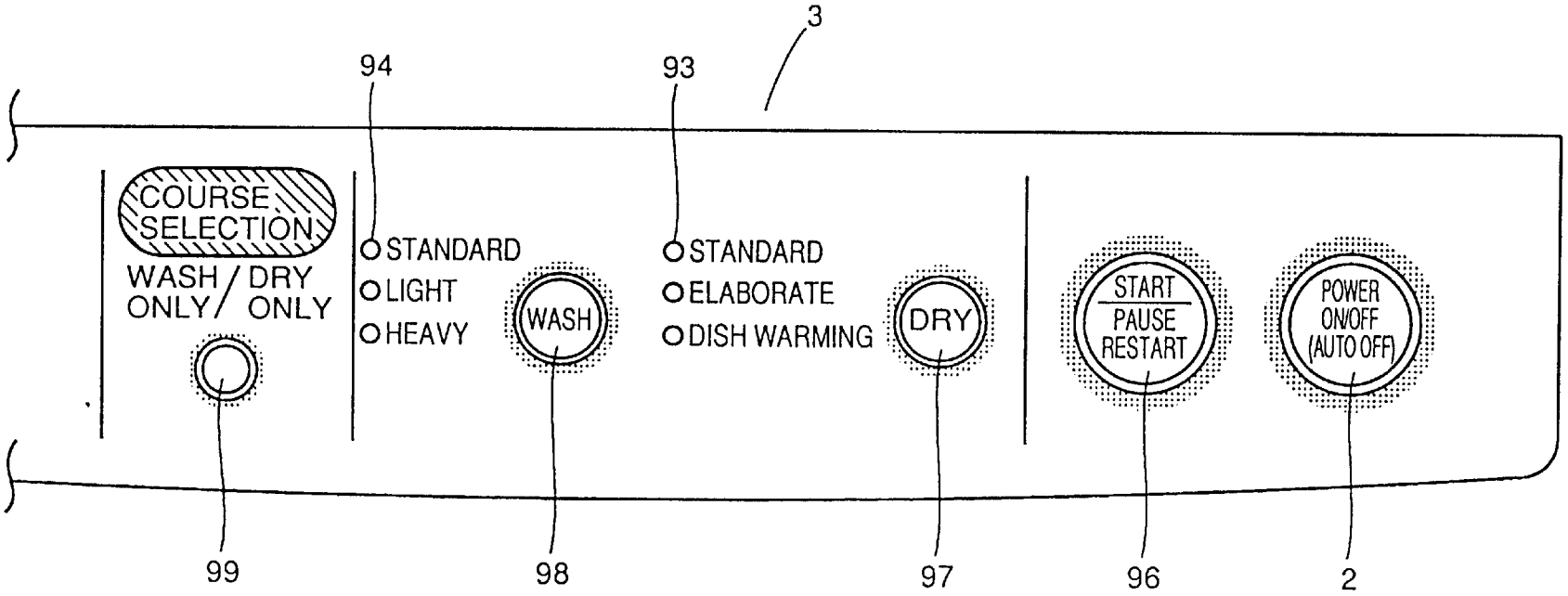
FIG. 29 is a plan view of the operation panel.

The operation panel 3 of the present embodiment will be described with reference to FIG. 29. Referring to FIG. 29, operation panel 3 includes a power on/off key 2 for turning on/off the power of dishwasher 1, a start key 96 for starting, posing or canceling posing (restarting) of dish washing or drying operation, a drying key 97 for selecting drying function, a washing key 98 for selecting condition of washing in accordance with the degree of dirt, a course selection key 99 for selecting one of two operation courses, that is, "washing only" and "drying only", and a cleaning key (not shown) for instructing cleaning, which has been already described.

Still referring to FIG. 29, operation panel 3 further includes drying condition indicating portion 93 arranged on the left side near the drying key 97 and consisting of three LEDs indicating selection of "standard drying," "elaborate drying" and "dish warming" from the top, and washing condition indicating portion 94 placed on the left side near the washing key 98 and consisting of three LEDs indicating selection of "standard," "light" and "heavy" from the top.

The drying condition indicating portion 93 is controlled by microcomputer 53 such that the lit position of the three LEDs moves in accordance with the number of pressing the drying key 97. Immediately after the power on, none of the LEDs is lit at the drying condition indicating portion 93. When the drying key 97 is pressed once, "standard" LED is lit, for example. When the drying key 97 is pressed twice, the LED for "elaborate drying" is lit. When drying key 97 is pressed three times, the LED at the position of "dish warming" is lit.

Washing condition indicating portion 94 is controlled by microcomputer 53 such that the position of the lit one of three LEDs moves in accordance with the number of pressing of washing key 98. Immediately after power on, none of the LEDs of the washing condition indicating portion 94 is lit. When washing key 98 is pressed once, the LED at the position of "standard" is lit. When washing key 98 is pressed twice, the LED at the position of "light" is lit. When washing key 98 is pressed three times, the LED at the position of "heavy" is lit.

Each of the LEDs of the drying condition indicating portion 93 and washing condition indicating portion 94 is controlled by microcomputer 53 such that when a course is set, it is lit as described above, the LED indicating the course which is being done flickers during operation and it is turned off when the operation is completed or the setting is canceled.

Now, conventional family use dishwasher does not have the function of demonstration. However, in order to help understand the operation of a turntable type dishwasher which has not been commonly used, the best way is to have users watch and see how the dishwasher operates actually. Especially the manner how the dishes rotate together with the turntable and washed clean is interesting. Therefore, providing the function of demonstration of the turntable type dishwasher is expected to be very effective. However, in that case, it should be clearly indicated that the dishwasher is performing demonstration. During demonstration, draining is not performed, and therefore if the user should activate demonstration at home, the operation might possibly be mistook as a failure of the dishwasher.

Accordingly, the dishwasher according to the present embodiment is provided with a function to start demonstration only when prescribed ones of the various keys on display panel 3 shown in FIG. 28 are pressed in a predetermined sequence. The key sequence is revealed to only a limited number of operators who are in charge of manufacturing or sales of the dishwasher. During demonstration, when power on/off key 2 is pressed, buzzer 92 rings a buzzer. By this buzzer, whether the dishwasher started demonstration or not can be determined. The buzzer is rung by microprocessor 53 sending a prescribed signal to buzzer 92, in response to the pressing of power on/off key 2 at the time of demonstration.

After the dishwasher enters the demonstration mode, when start key 96 is pressed, the washing operation in demonstration is started by the dishwasher. In demonstration, microcomputer 53 operates the dishwasher at a speed of operation several times that of the normal operation. The reason for this is that in normal operation, the operation of the dishwasher continues several tens of minutes, which is not suitable for demonstration. By speeding up operation during demonstration, the necessary time for demonstration can be made shorter, effectively showing the operation of the dishwasher to potential users. If the dishwasher is operated at ten times the speed of normal operation, the necessary time would be 1/10, and therefore a sales agent may explain all the operation cycles of the dishwasher in only several minutes.

During demonstration, microcomputer 53 operates driving motor 22 and circulation pump 32. Dish washing basket 8 rotates, water is jet out from washing nozzle 26 and washing starts. At this time, sheathed heater 13 and water feed valve 55 may be operated without any problem. However, draining is not performed. By rotating circulation pump 32 in reverse direction, the washing water in washing chamber 7 can be drained. However, at the time of demonstration, microcomputer 53 keeps relay L4 for controlling rotation of circulation pump 32 at a contact A for forward rotation, so that at least the circulation pump 32 is not rotated in reverse direction, as shown in FIG. 27.

Referring to FIG. 27, during washing operation, relay L4 is connected to the contact A on the positive rotation side of circulation pump 32. At the time of draining, relay L4 is connected to the contact B on the reverse rotation side of circulation pump 32.

As already described, during demonstration, draining of water of the dishwasher is not performed, since it is difficult to provide water feed/drain system at a sales site. It may be possible to provide water feed and draining system by expending much cost. However, such cost for demonstration is burdensome. Further, demonstration is repeated many times and thus draining at every demonstration would waste water.

If rotation of dish washing basket 8 stops during operation of the dishwasher in accordance with the present embodiment, a warning indication is given in the following manner. For the warning, the LEDs of the drying condition indicating portion 93 and washing condition indicating portion 94 shown in FIG. 29 are used. More specifically, a combination of LEDs in accordance with the state of error are flickered. Selection of the LEDs to be flickered and control of flickering are done by microcomputer 53.

Referring to FIG. 30, when rotation of dish washing basket 8 stops, the LED at the position of "light" and at the washing condition indicating portion 94 and the LED at the position of "elaborate" of drying condition indicating portion 93 are flickered simultaneously. If draining fails, the LED at the position of "standard" of the washing condition indicating portion 94 and the LED at the position of "dish warming" of drying condition indicating portion 93 are flickered simultaneously. If water feed fails, the LED at the position of "standard" at the washing condition indicating portion and the LED at the position of "standard" of the drying condition indicating portion 93 are flickered simultaneously. In case of other errors, the LED at the position of "standard" of the washing condition indicating portion 94 and the LED at the position of "elaborate" of the drying condition indicating portion are flickered simultaneously. By the combination of flickering LEDs, the user and/or maintenance operator can readily know the defective portion, thus operability and serviceability of the dishwasher can be improved.

Further, when rotation of dish washing basket 8 fails, in addition to the flickering of LEDs, a warning is given by buzzer 92 (see FIG. 28). The reason for this is to surely inform the user of the failure to stop operation, since if other parts operate while driving motor 22 is stopped, the washing and drying performance degrade and water and electricity are wasted.

However, if the user is absent near the dishwasher, the warning of buzzer 92 may be missed. Namely, flickering of LEDs and warning by buzzer 92 are not sufficient. Therefore, the dishwasher in accordance with the present embodiment includes a relay L5 inserted in series to the power source, as shown in FIG. 28. When the signal from microswitch 52 fails, that is, when dish washing basket 8 is stopped, microcomputer 53 opens relay L5. Then power supply to all the electric components (driving motor 22, circulation pump 32, sheathed heater 13 and water feed valve 55) is cut. Since other electric parts do not operate when the driving motor 22 stops, safety can be improved. Further, the dishwasher cannot continue the washing and drying operation when satisfactory washing is impossible. Therefore, degradation of washing and drying performance can be prevented, and the water and/or electricity is not wasted.

Now, when the driving motor 22 fails to operate, it may be sufficient to cut off the power supply to driving motor 22 only. However, this involves the following problem. For example, the driving motor 22 may fail to operate because of a dish or chopstick formed of plastic resin or wood happens to be pinched between the sheathed heater 13 and the dish washing basket 8. In such a case, when only the power supply to the driving motor 22 is cut while the power supply to the sheathed heater 13 is kept on, the chopstick or dish may be in contact with the sheathed heater and overheated, causing fire. The power supply to all the electric component are cut in order to prevent such a problem.

FIG. 31 shows a table of courses of operation prepared for the dishwasher of the present embodiment and time necessary for respective processes of respective operation courses. In general operation, the steps of water feed, washing, drying, draining, water feed, rinsing, draining and drying are performed in this order.

When drying key 97 (see FIG. 29) is pressed three times, the function of "dish warming" is selected. In dish warming operation, washing or rinsing step is not performed, and only the step of drying is performed. In drying operation, the dishes are dried by feeding hot air of about 50° C. or higher. To indicate that the drying operation is in progress, the LED at the drying condition displaying portion 93 is flickered. After the lapse of a predetermined drying time, the drying operation is terminated.

After the end of drying operation, when the washing chamber is left as it is, the temperature in the drying chamber lowers. The dishwasher of the present embodiment has a function of keeping warm the objects for a prescribed time period after the end of drying. The temperature at that time is set lower than the temperature for the drying operation.

While the objects are kept warm, in order to distinguish the temperature keeping operation from the drying operation, the LED at the drying condition displaying portion 93 is flickered with longer interval than in the drying operation. Since the temperature keeping operation and the drying operation are distinguished from each other by the manner of flickering of the LED, the user can readily know that the drying operation has been terminated and the dishwasher is in the temperature keeping operation. When the time for temperature keeping is set at about 30 minutes, it is possible to serve food on warm dishes even when the user is away from the dishwasher for sometime. Further, as the dishes are kept warm, propagation of miscellaneous contaminants can be suppressed.

In the steps from washing to drying in normal washing operation, a rinsing agent may be added to water, in order to facilitate draining after rinsing and to prevent water marks from being left on the surfaces of the dishes after drying. It has been conventionally known that rinsing agent facilitates draining. However, conventionally, the user puts in the rinsing agent at an arbitrary timing. However, it is difficult to determined a good timing to put in the rinsing agent, and the effect considerably differs dependent on when the rinsing agent is put in during the step of rinsing.

Accordingly, the dishwasher of the present embodiment has a function of informing the timing to put in the rinsing agent. More specifically, the optimal timing for putting in the rinsing agent is studied by experiment in advance, and the timing is stored in microcomputer 53. When the timing is reached in the rinsing step, microcomputer 53 informs by buzzer 92. In this manner, the user can put in the rinsing agent to the dishwasher at a timing when the effect of rinsing agent is fully exhibited, without failure or difficulty. The dishwasher continues rinsing operation no matter whether the timing of putting in the rinsing agent is informed or not. The user may temporary stop the operation of the dishwasher by pressing start key 96 after the timing is informed, opens the door 4 and put in the rinsing agent to washing tank 7. Thereafter, the user closes the door 4 and presses start key 96 again, so that the dishwasher restarts operation.

Figure 32:
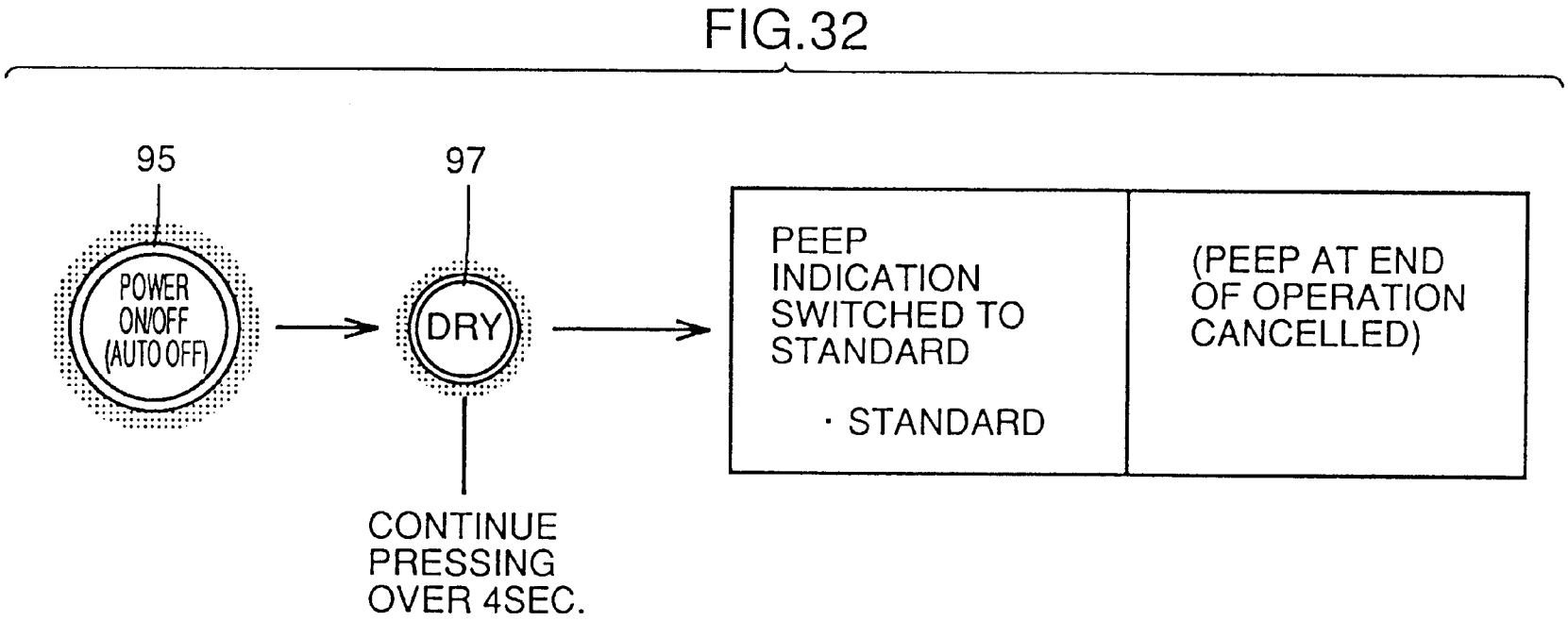
FIG. 32 shows the manner of setting off the alarm sound.

Now, in the dishwasher of the present embodiment, the timing for putting in the rinsing agent and completion of operation are noticed by the sound of buzzer 92. However, the sound may not be comfortable to every user. Therefore, ringing of buzzer 92 is not performed when a special key operation is performed in the dishwasher 1 of the present embodiment. More specifically, referring to FIG. 32, after power is turned on by pressing power off/on key 2 and drying key 97 is pressed continuously over four seconds, microcomputer 53 recognizes this special operation, and controls buzzer 92 so as not to generate any sound thereafter. A dishwasher which can operate in more preferably state for the user is provided.

After the start of washing operation, microcomputer 53 determines whether or not a pulse signal is received at a prescribed period from microswitch 52. As long as the pulse signal is received at a prescribed period, dishwasher 1 is operating normally.

If the dish washing basket 8 fails to rotate by some accident, the gear 23 which engages with the gear 9 of dish washing basket 8 also fails to rotate. Cum 51 also stops. Accordingly, the pulse signal which has been generated periodically from microswitch 52 stops. In that case, microcomputer 53 stops driving motor 22, generates a warning by buzzer 92, and/or drying condition indicating portion 93 and/or washing condition indicating portion 94, so as to inform the user of the failure.

The dish washing basket 8 may stop when washing filter 19 is not attached, the object to be washed happens to be caught by a projection in the washing chamber 7, or rotary gear 23 or dish washing basket 8 is damaged.

When the objects to be washed are placed at one portion of dish washing basket 8 and washed, the dish washing basket 8 may stop at a position where the objects are positioned deep inside the washing chamber 7 at the end of washing operation. In that case, it is troublesome to take out the objects from the dish washing basket 8. Therefore, the angle of rotation of dish washing basket 8 at the start of operation is stored in microcomputer 53, and when the operation is to be stopped, the driving motor 22 is stopped when the angle of rotation of the dish washing basket 8 matches the stored value. Since the dish washing basket 8 stops in the same attitude as at the start of rotation, objects can be readily taken out.

Further, it is possible to detect frequency of AC power source by detecting the speed of rotation of dish washing basket 8 and to control time of washing in accordance with the detected frequency, or to change the speed of rotation of the dish washing basket 8 itself. A device other than microswitch, such as a sensor including a photo triac may be used for detecting rotation of dish washing basket 8. However, microswitch is preferable, since it simplifies circuitry and the parts are not expensive. It goes without saying that any device which is less expensive and having function comparable to the microprocessor may be used.

In the present embodiment, when an impeller of circulation pump 32 is rotated in positive direction, the washing water or waste water after washing in water tank 12 is absorbed in water absorbing inlet 33, supplied to washing nozzle 26 of washing chamber 7 and washing water is jet out. When impeller of circulation pump 32 is rotated in reverse direction, waste water after washing is drained.

Figure 22:
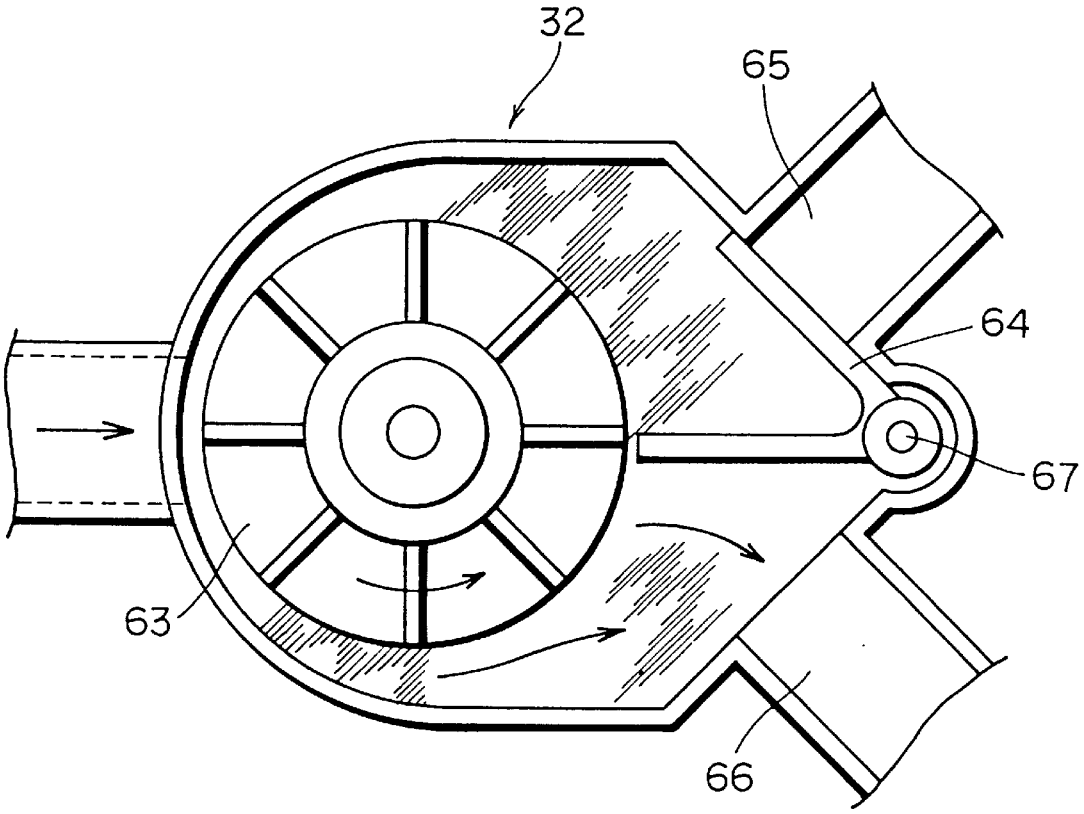
FIG. 22 is a schematic cross section of the circulation pump.
Figure 23:
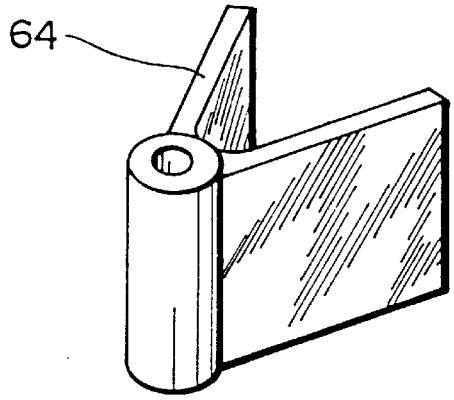
FIG. 23 is a perspective view of a switch valve.
Figure 24:
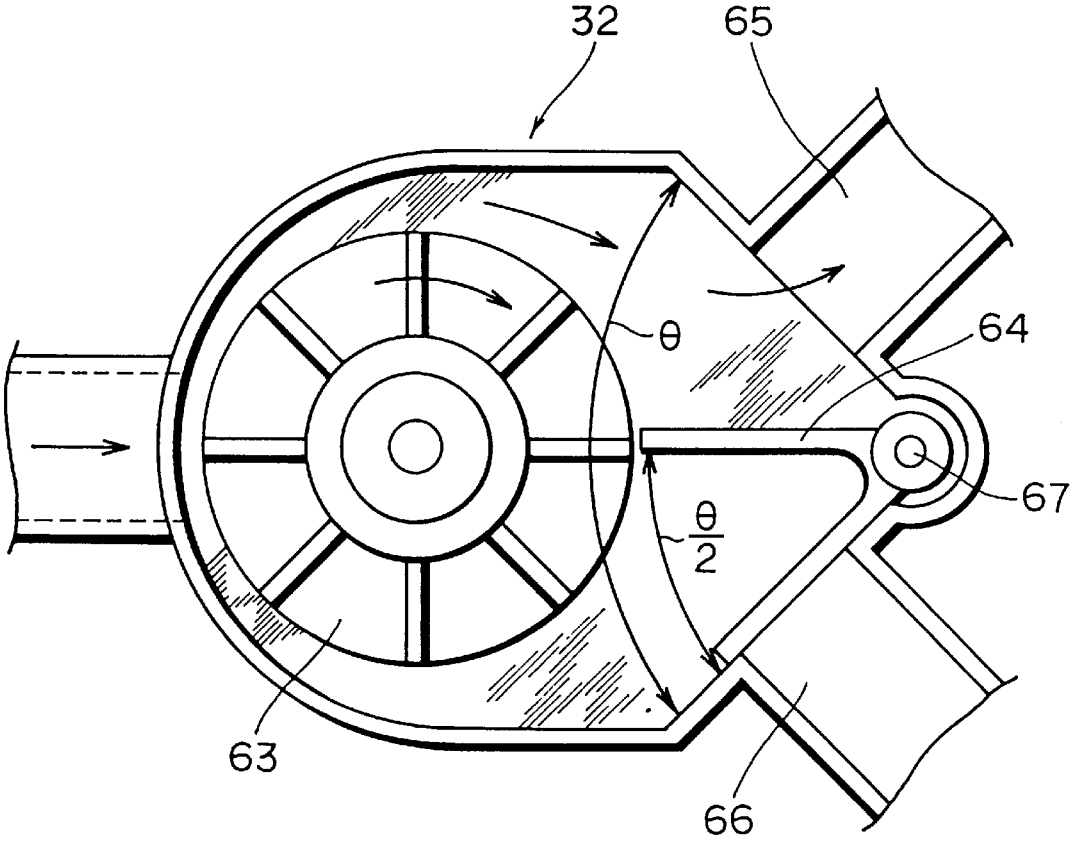
FIG. 24 is a schematic cross section of the circulation pump.

Referring to FIGS. 22 and 24, circulation pump 32 includes a casing communicated with washing outlet 65 and drain outlet 66 at two surfaces crossing at an angle θ, an impeller 63 provided in the casing, and a switching valve 64 formed of a resilient body for guiding washing water to either the washing outlet 65 or draining outlet 66, which valve is provided rotatably about a fulcrum 67 positioned corresponding to the crossing of the two surfaces communicating with the washing outlet 65 and draining outlet 66. Switching valve 64 has a V-shape opening at an angle of θ/2 as shown in FIG. 23, and the vertex of the V-shape is positioned at the fulcrum 67. When the switching valve 64 is rotated to the side of washing outlet 65, the washing outlet 65 is covered watertight by switching valve 64. When switching valve 64 rotates in the reverse direction, the drain outlet 66 is covered watertight by switching valve 64.

Referring to FIG. 24, at the time of washing, impeller 63 rotates in forward direction. By the water flow caused by impeller 63, switching valve 64 rotates, watertightly closing the draining outlet 66. The washing water from water tank 12 is supplied to washing nozzle 26 and jet out to washing chamber 7.

At the time of draining, referring to FIG. 22, impeller 63 rotates in the reverse direction. By the water flow caused by impeller 63, switching valve 64 rotates, watertightly closing washing outlet 65. Waste water after washing from water tank 12 is drained through drain outlet 66.

When impeller 63 is rotated in forward and rearward directions initially at the start of washing operation, switching valve rotates. When the proper washing operation starts thereafter, the washing valve 64 can be switched smooth.

Not only the direction of rotation but also the speed of rotation of impeller 63 can be changed. Especially at the time of draining, high water pressure is not necessary. Therefore, the speed of rotation of impeller 63 can be reduced, and as a result, noise can be reduced.

Figure 21:
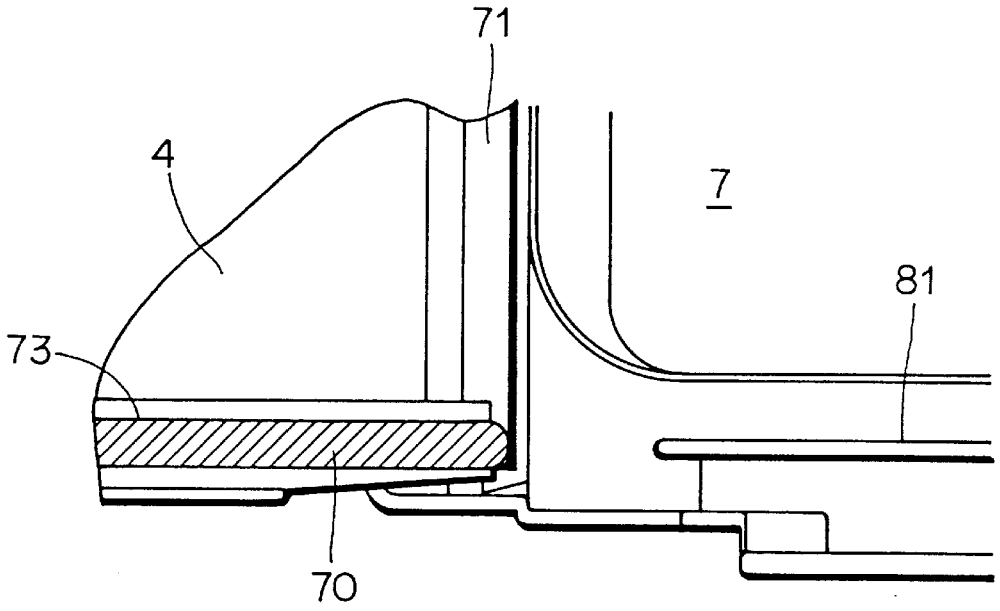
FIG. 21 is a side view of FIG. 19.

Referring to FIGS. 4, 19, 20 and 21, a continuous first packing 70 is fitted in a trench 73 on the left and right and upper end portion inside the door 4 (see FIG. 21). Lower ends of packing 70 are folded into U-shape. A second plate-shaped packing 71 is provided at a lower side portion of door 4. Packing 70 is fixed together with packing 71 by a keep fitting 72 at both ends of packing 71. Though there is rotational friction when door 4 is opened/closed, falling off of packings 70 and 71 by the friction can be prevented by the keep fitting 72.

When the door 4 is closed, the first and second packings 70 and 71 on the side of the door 4 are in tight contact with a water proof rib 81 on the front opening on the side of the washing chamber shown in FIG. 21, effectively preventing leakage of water.

Figure 25:
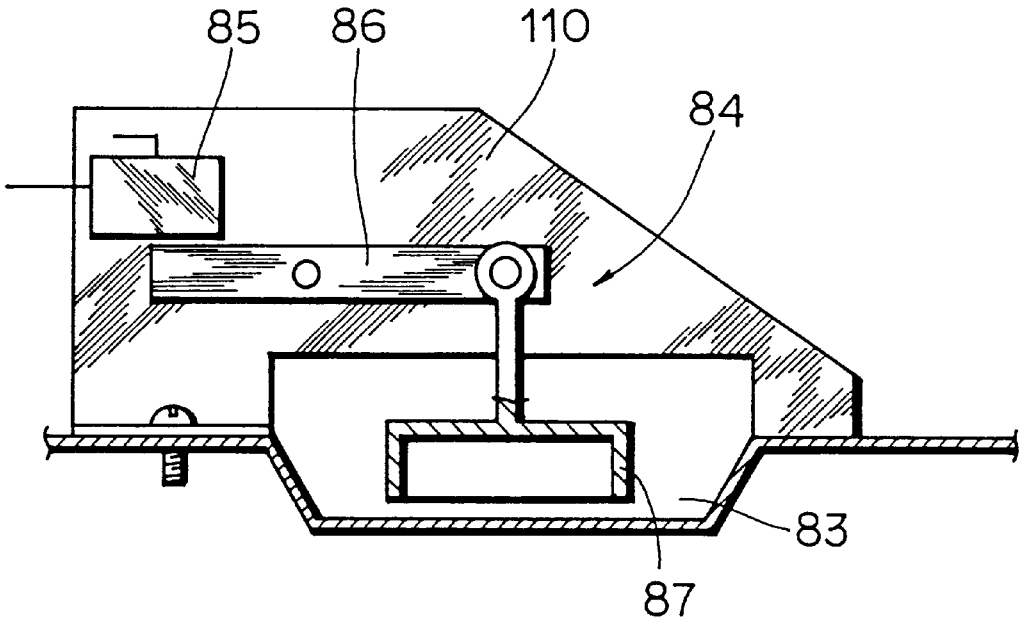
FIG. 25 shows a float switch for detecting water level.
Figure 26:
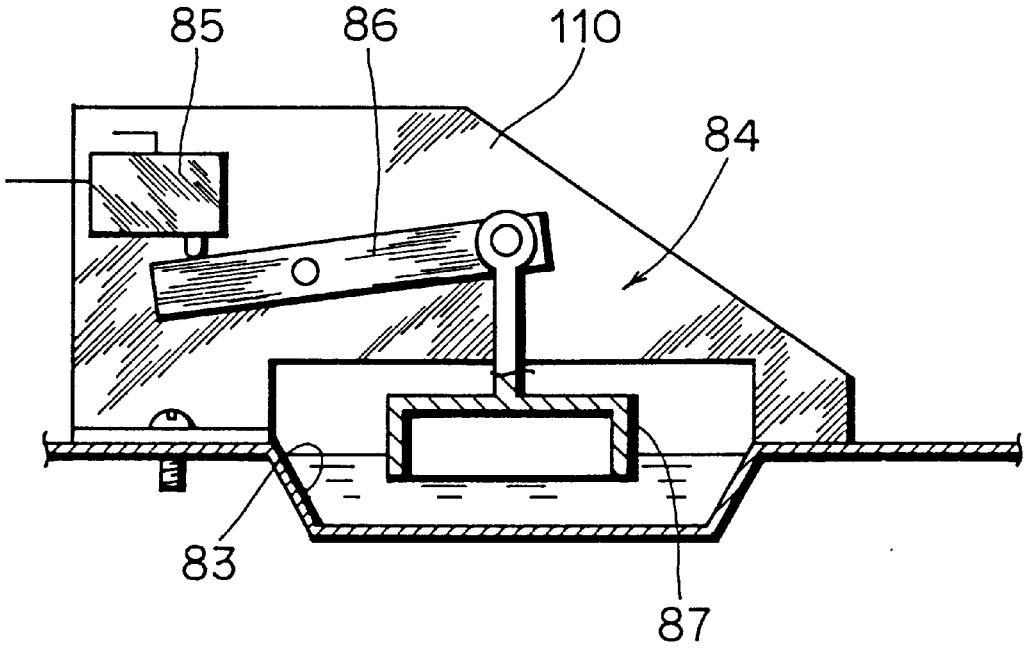
FIG. 26 shows the float switch for detecting water level.

If water should leak, it is detected in the following manner. Referring to the figures, a water level detection float switch 84 shown in FIG. 25 is provided at a water pool portion 83 of bottom plate 82. The water level detection float switch 84 is attached by a holder 110 at water pool portion 83. Water level detection float switch 84 includes a float 87 having a projection at the central portion, a lever 86 having one end rotatably attached to the projecting portion of float 87 and rotating about a fulcrum provided on holder 110, and a microswitch 85 fixed on holder 110 at a position which is in contact with an upper surface of the free end of lever 86. Microswitch 85 has a retractable switch member on its lower surface, and when this member is pushed in microswitch 85, it turns off, and when it protrudes outward from microswitch 85, it turns on.

Normally, the switch member of microswitch 85 is pushed in microswitch 85 by the free end of lever 86 as shown in FIG. 25. Microswitch 85 is off. When water level of water pool portion 83 becomes higher, float 87 floats. When one end of lever 86 goes upward, the other end goes downward, and therefore the switch member protrudes downward from microswitch 85. Thus microswitch 85 turns on.

Microcomputer 53 closes water feed valve 55 for feeding water to washing chamber 7 and stops water feed in response to the output from microswitch 85. Microswitch 53 may operate circulation pump 32 so as to drain water in water tank 12 of washing chamber 7. Further, microcomputer 53 may generate some alarm sound or gives some alarm indication to inform the user that the water level of water pool portion 83 exceeded a certain level.

The dishwasher 1 in accordance with the present embodiment operates in the following manner. Dishwasher 1 is connected to a power source and supplied with power for washing and drying the objects. Further, dishwasher 1 is connected to service water to receive washing water, and after washing, water is discharged to the drain outlet connected to drainage.

The drain duct leading to the drain outlet connected to the drainage is connected to circulation pump 32 described above with switch valve 64 interposed.

When the dishwasher starts operation, circulation pump 32 causes water flow, opens washing path by operating switching valve 64, and cuts off the path to drain duct. Water feed valve 55 is operated so that service water is fed to the water tank 12 of washing chamber 7.

The level of water tank 12 is detected by water level sensor 54. Microcomputer 53 monitors output from water sensor 54 and when water in water tank 12 reaches a prescribed amount, it closes the water feed valve 55. Feeding of service water stops.

Thereafter, microcomputer 53 operates circulation pump 32. Water in water tank 12 is sucked up through water absorbing inlet 33 of water tank 12 together with previously input detergent, and fed to a washing water path leading to washing nozzle 26. The water is further jetted out from washing nozzle 26 to washing chamber 7 toward the objects. The water is reserved in water tank 12 at the bottom portion of washing chamber 7. The water is again sucked up from water tank 12 by circulation pump 32 and circulated.

Heater 13 in water tank 12 is dipped in washing water. When power is supplied to heater 13, the washing water is heated. As the temperature of water increases, it becomes easier to clean off the dirt on the objects.

The temperature of washing water is measured by a temperature sensor provided in the washing path. Microcomputer 53 controls heater 13 and keeps the washing water at a temperature where the ability of detergent is fully exhibited (generally, 60° C.). The objects rotate together with dish washing basket 8. The objects receive water only when it is positioned in front of washing nozzle 26. As dish washing basket 8 rotates at a constant speed, water is uniformly received by the plurality of objects.

The dirt on the objects is separated from the objects by the hot water and dissolves into the washing water. The dirt is deposited on washing filter 19 provided in the washing path at the bottom portion of washing chamber 7. After a prescribed time period in which washing is repeated, dirt of the objects is sufficiently removed. Then microcomputer 53 stops power supply to heater 13, and rotates circulation pump 32 in reverse direction. Because of the water flow caused by circulation pump 32, switching valve 64 operates and the water flow path is switched to the drain path. More specifically, the path to the drain duct is opened and the washing path is closed. The water is passed through drain duct and drained through drain output.

After sufficient draining, the process proceeds to the step of rinsing. In the step of rinsing, in the similar manner in the step of washing, circulation pump 32 is rotated in the forward direction to operate switching valve 64, the washing path is opened and the draining path is closed. Microcomputer 53 operates the water feed valve 55, and feeds a prescribed amount of service water to water tank 12. Circulation pump 32 is operated while dish washing basket 8 is rotated, and washing water is jetted out to the objects. A few minutes after the start of jetting, switch valve 64 is operated to open the draining path. The water in water tank 12 passes through the drain path and discharged through the drain duct. Generally, the step of rinsing is repeated several times so that concentration of washing water is gradually lowered.

After the rinsing step is rotated several times, the circulation pump 32 is again rotated in the forward direction to open switch valve 64, so that the washing path is opened. The drain path is closed. By operating water feed valve 55, a prescribed amount of service water is fed to water tank 12. Circulation pump 32 is operated while rotating the dish washing basket 8, and washing water is jetted to the objects. At this time, power is supplied to heater 13 to increase the temperature of water. This is the final rinsing step.

In the final rinsing step, the temperature of washing water is increased to about 70° C. Miscellaneous contaminants on the objects are killed by the hot water. Further, oil which has been removed but adhered again on the object during the step of washing and solidified as it is cooled by water melts and removed from the objects.

Microcomputer monitors the output from temperature sensor and stops power supply to heater 13 when the temperature of washing water attains about 70° C., and operates circulation pump 32 in reverse direction. The drain path is opened and the washing path is closed. Water in water tank 12 is discharged. After a sufficient time period for completing drainage of water, microcomputer 53 stops power supply to circulation pump 32, and the last step of rinsing is completed.

After the step of final rinsing, microcomputer 53 supplies power to air blower motor 27. Air blower motor 27 rotates air blower 28 to generate air flow, and the air is introduced from air inlet 29 on the sidewalls of water tank 12 to washing chamber 7. The air introduced from air inlet 29 to washing chamber 7 is uniformly directed to the objects placed on the rotating dish washing basket 8. The air carries away moisture generating from water on the objects to the outside of washing chamber 7 through an air outlet.

Microcomputer 53 operates air blower motor 27 for a sufficient time period to ensure sufficient evaporation of water on the surface of the objects, and stops power supply to air blower motor 27 and to driving motor 22 for rotating dish washing basket 8. Thus the process is completed.

As described above, in the present embodiment, the power transmission mechanism for transmitting rotary power from a driving source to the dish washing basket is arranged at a deep corner of the washing chamber. Since a space at the corner of the cabinet which would be otherwise wasted can be well utilized, the dishwasher can be made smaller. Further, in the present embodiment, an opening through which a portion of the power transmitting mechanism faces the washing chamber is provided at the washing chamber. Washing water is supplied through this opening into the washing chamber. Accordingly, it becomes unnecessary to provide a separate water inlet, and space of the washing chamber can be utilized effectively. Further, the number of components related to water feeding can be reduced, and thus cost of the overall dishwasher can be reduced. Since a portion of the power transmitting mechanism faces the washing chamber through the opening, garbage or waste adhered on some part of the power transmitting mechanism can be washed away when the water is fed at the time of washing. Accordingly, the power transmitting mechanism is always kept clean, enabling smooth transmission of power.

Figure 33:
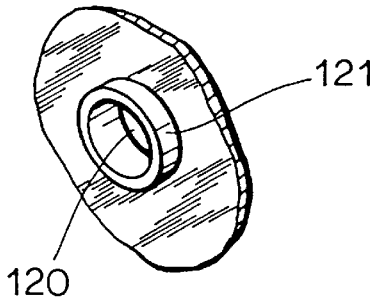
FIG. 33 shows, in enlargement, the jet opening of the washing nozzle in accordance with another embodiment.

In place of the jet outlet 36 of the washing nozzle shown in FIG. 13, for example, a jet outlet 120 such as shown in FIG. 33 may be provided. The jet outlet 120 has an annular rib 121 provided on an inner peripheral surface of an outer peripheral surface of the nozzle. By the presence of annular rib 121, more linear delivery of water becomes possible. This enables more efficient washing of the objects.

Figure 34:
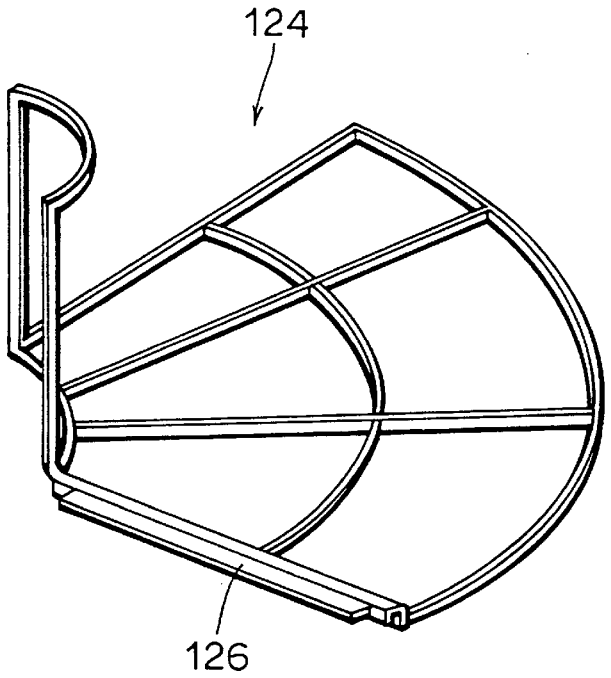
FIG. 34 is a perspective view of the additional basket for small articles in accordance with another embodiment.
Figure 35:
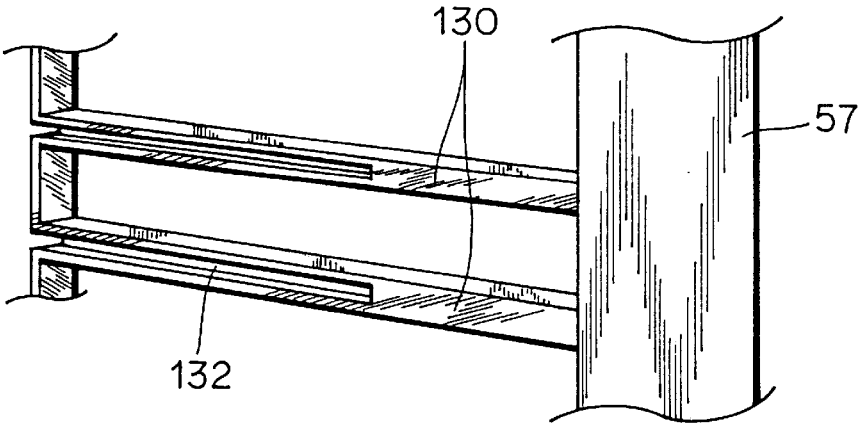
FIG. 35 is a perspective view of a main portion of the dish washing basket in accordance with another embodiment.

The angle of attachment of support bar 60 and the shape of additional basket 61 are not limited to those shown in FIG. 17. Further, the manner of attachment of additional basket 61 on support bar 60 is not limited to that described in the above embodiment. For example, referring to FIG. 34, in another embodiment, the additional basket 124 has a fan-like shape, with protruding portions 126 on the outside of the linear end surfaces of the fan. Referring to FIG. 35, one support bar 130 has a notched portion 132 on a side surface. By inserting the projections 126 into the notched portions 132 on the side surfaces, additional basket 124 can be attached to the dish washing basket.

Figure 36:
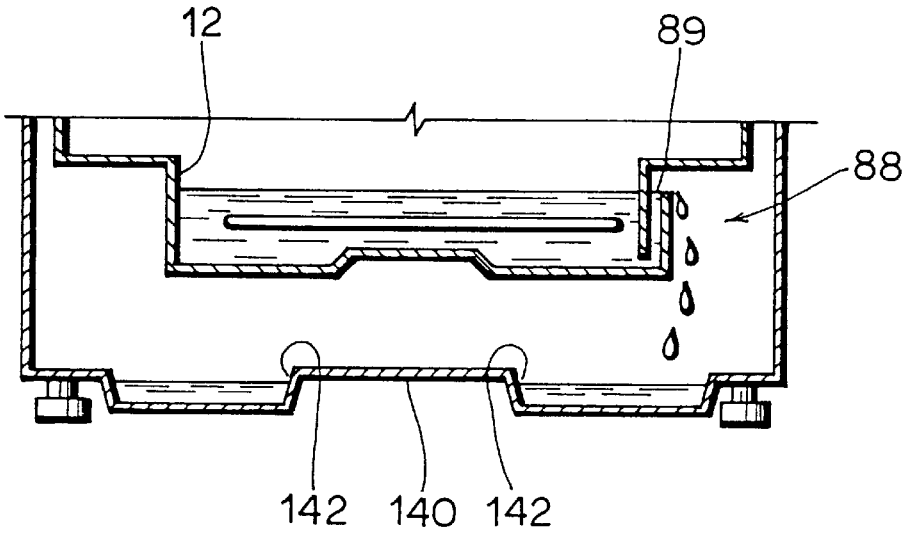
FIG. 36 shows a position of the water level float switch in accordance with another embodiment.
Figure 37:
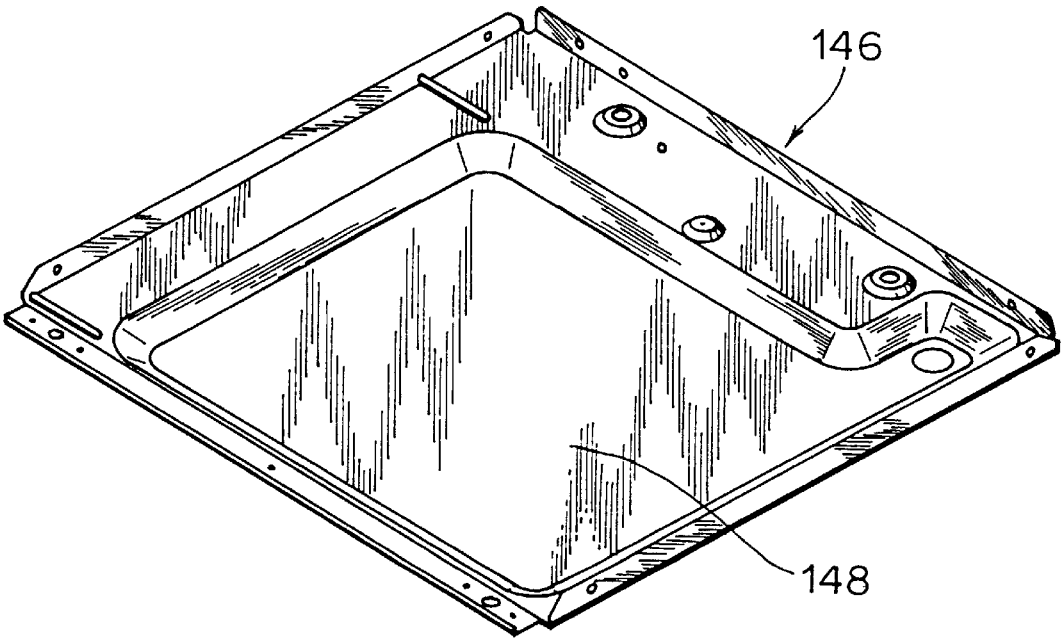
FIG. 37 is a perspective view of a bottom plate.

Further, the water level detection float switch is arranged in water tank 12 as shown in FIG. 25. However, dependent on the structure of the dishwasher, the water level detection float switch may be arranged at an appropriate position. For example, referring to FIG. 36, the dishwasher may include a overflow equipment 88 causing overflow of water exceeding a prescribed level in water tank 12 to the outside of water tank 12 through a water outlet 89, and a bottom plate 140 having a convex water pool portion 142 for receiving water let out from the water tank 12 by overflow equipment 88. In that case, the water level detection float switch 84 may be arranged in water pool portion 142. The water pool portion 142 may have any shape. Different from FIG. 36, for example, the water pool portion 148 may be formed by removing the peripheral portion of bottom plate 146 as shown in FIG. 37.

Figure 38:
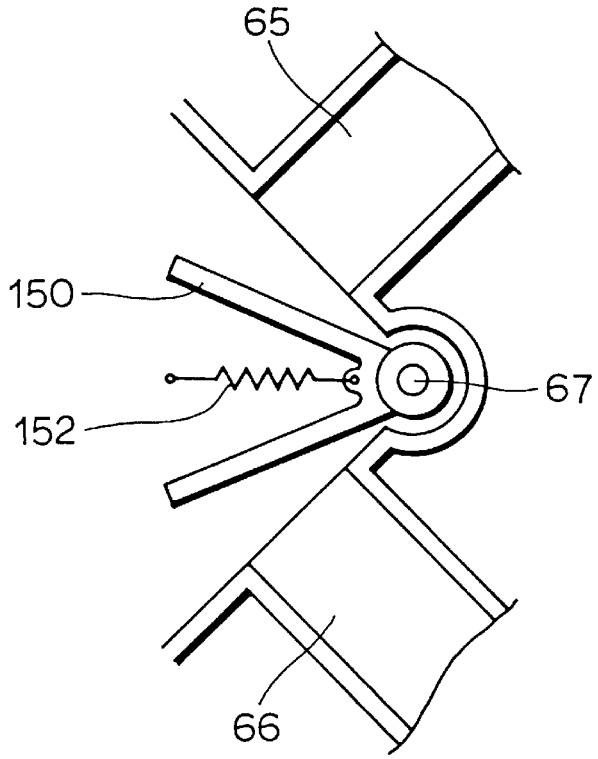
FIG. 38 is a cross section near the switch valve in accordance with another embodiment.

Assume that switching valve 64 shown in FIG. 22 watertightly close either of the outlet and opens the other, while washing is not performed. When washing start, water pressure is applied to both sides of the V-shaped switching valve 64, hindering smooth rotation of switching valve 64. In order to solve this problem, referring to FIG. 38, a spring 152 may be provided in circulation pump 32, a switching valve 150 which is forced to the central position by the spring 152 in the absence of water flow may be used in place of the switching valve 64 shown in FIG. 22. In this manner, as the impeller 63 rotates in the forward and rearward directions, switch valve 150 rotates smooth, guiding washing water or waste water to the desired outlet.

Figure 39:
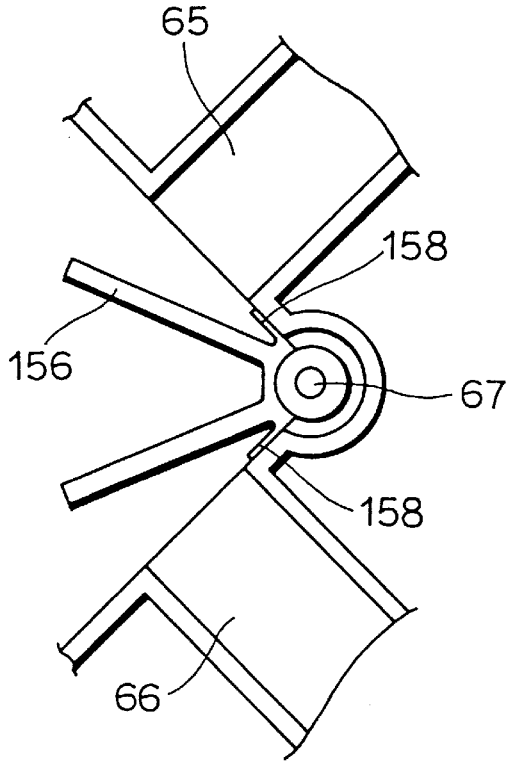
FIG. 39 is a cross section near the switch valve in accordance with still another embodiment.

Referring to FIG. 39, a switching valve 156 having a resilient piece 158 urging the switching valve 156 to the central direction may be used in place of switching valve 68 shown in FIG. 22. Further, to return the switching valve to the center, a magnet may be used.

Figure 40:
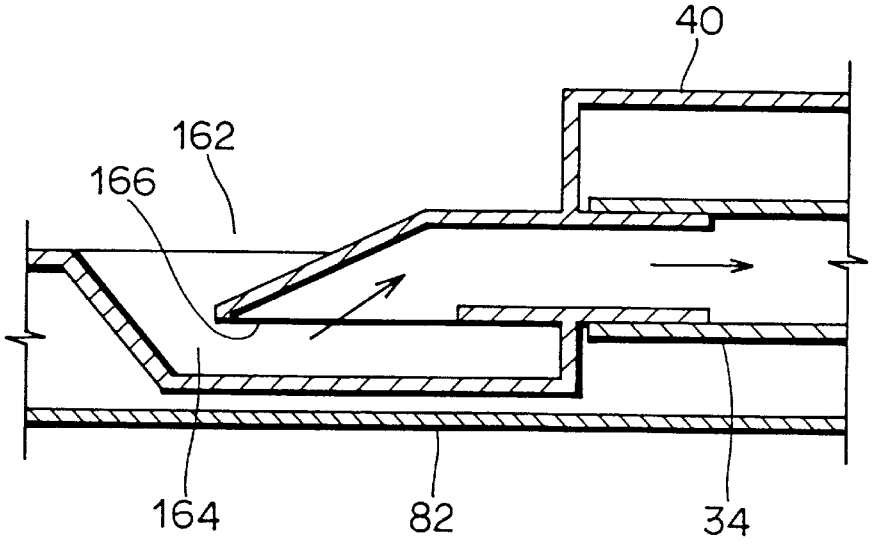
FIG. 40 is a cross section of a water tank having a water pool portion.
Figure 41:
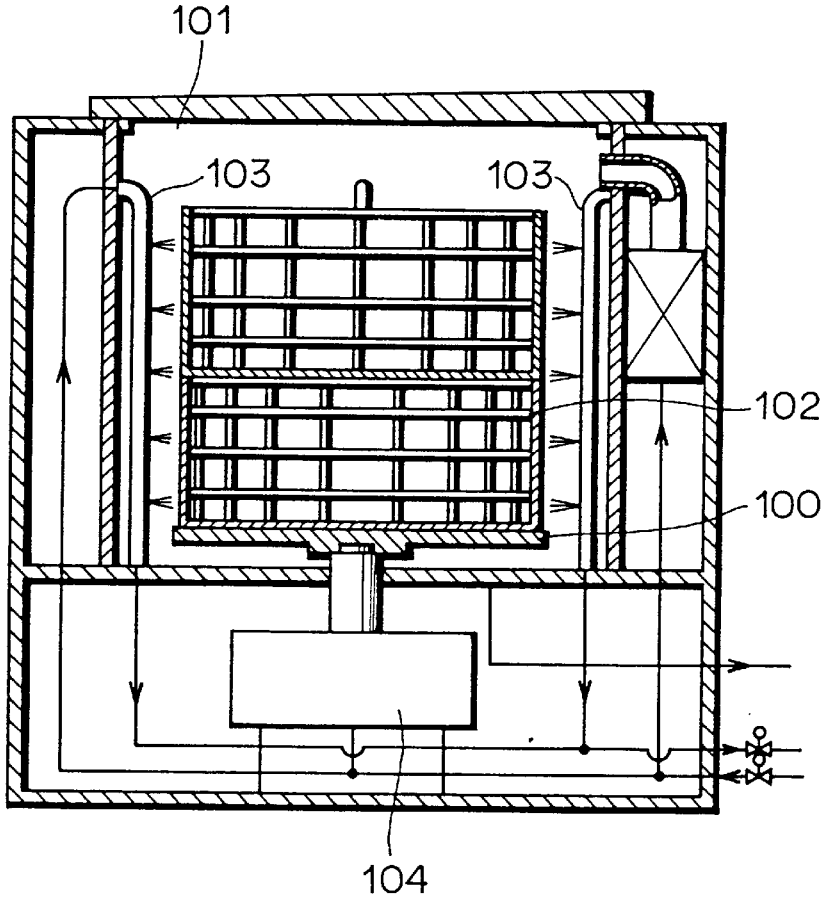
FIG.41 PRIOR ART
FIG. 41 is a cross section of a conventional dishwasher.

In the above described embodiment, the water absorbing inlet 33 of water tank 12 is provided on the sidewall of water tank 12. However, the position of the water absorbing inlet 33 is not limited thereto. For example, referring to FIG. 40, a water tank 162 having a water pool portion 164 provided lower than the bottom portion thereof may be used instead of water tank 12, and instead of inlet 33, an inlet 166 protruding from washing chamber member 40 and having an opening facing the water pool portion 164 may be provided. In the structure shown in FIG. 40, washing water does not remain in water tank 162 at the time of draining. Though some water is left in water pool portion 164, odor of water, for example, does not remain in water chamber 7 but in a space in the inlet 166. Thus diffusion of odor in washing chamber 7 can be prevented.

In the above described embodiment, the dish washing basket 8 has a gear 9 at its lower portion, and by engagement of rotary gear 23 and gear 9, the dish washing basket 8 is directly driven to rotate as a turn table. However, the mechanism for rotating the dish washing basket 8 is not limited thereto. For example, the dish washing basket may be a separate body from the turn table, and not the dish washing basket but the turntable on which the basket is placed may be rotated.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dishwasher, comprising:

a cabinet having an opening on a front surface;

a door attached to said cabinet to open/close at said opening of said cabinet;

a washing chamber member provided in said cabinet and forming a washing chamber facing said opening of said cabinet;

a washing nozzle provided facing a certain direction of said washing chamber;

a circulation pump coupled to said washing nozzle, a bottom portion of said washing chamber and an external drain outlet;

a driving source provided outside said washing chamber;

a power transmission mechanism provided at a corner in said cabinet on one side of said cabinet and outside said washing chamber and coupled to said driving source;

an opening located at the corner of said cabinet at which said power transmission mechanism is positioned so that said power transmission mechanism protrudes into said washing chamber through said opening located at the corner of said cabinet; and a control circuit for controlling said circulation pump and said driving source; wherein a dish washing basket placed in said washing chamber is rotated by said power transmission mechanism, and wherein said opening located at the corner of said cabinet further functions as a water inlet to said washing chamber.

2. The dishwasher according to claim 1, wherein said washing chamber member further includes a water inlet which communicates with said opening of said washing chamber member and is connected to a water feed source, said dishwasher further comprising:

water feed valve provided between said water feed source and said water inlet and controlled by said control circuit, wherein washing water is supplied to said washing chamber through said water inlet.

3. The dishwasher according to claim 1, further comprising a sensor for sensing rotation of said dish washing basket, wherein said control circuit controls operation of said dishwasher based on an output from said sensor.

4. The dishwasher according to claim 1, wherein said washing nozzle is arranged at a deep corner of said washing chamber on a side opposite to said power transmission mechanism.

5. The dishwasher according to claim 4, wherein said washing nozzle has jet outlets dispersed along the height direction of said washing chamber.

6. The dishwasher according to claim 1, wherein said washing chamber member has a washing pipe coupled to said circulation pump, formed at a position where said washing nozzle is arranged, said washing nozzle being attachable/detachable to/from said washing pipe.

7. The dishwasher according to claim 6, further comprising a quarter spherical guide member which opens upward, and is to at least an uppermost one of said plurality of jet outlets.

8. The dishwasher according to claim 1, wherein an upper edge of said opening of the front surface of said cabinet is recessed to a prescribed position of an upper surface of said cabinet, and front edges forming side edges of said opening of both sidewalls of said cabinet are inclined rearward of said cabinet.

9. The dishwasher according to claim 1, wherein said door is opened as it is rotated about a lower edge of said opening of said cabinet, and a surface of said door facing said cabinet has a concave portion in accordance with an envelope shape formed when the dish washing basket in said washing chamber rotates.

10. The dishwasher according to claim 1, wherein said cabinet includes a bottom plate having a concave water pool portion, said dishwasher further comprising a water leakage sensor provided in said water pool portion.

11. A dishwasher comprising:

a cabinet having an opening on a front surface;

a door attached to said cabinet to open/close at said opening of said cabinet;

a washing chamber member provided in said cabinet and forming a washing chamber facing said opening of said cabinet;

a washing nozzle provided facing a certain direction of said washing chamber;

a circulation pump coupled to said washing nozzle, a bottom portion of said washing chamber and an external drain outlet;

a driving source provided outside said washing chamber;

a power transmission mechanism provided at a corner in said cabinet on one side of said cabinet, outside said washing chamber, and coupled to said driving source; and a control circuit for controlling said circulation pump and said driving source; wherein a dish washing basket placed on said washing chamber is rotated by said power transmission mechanism, wherein said washing chamber member has an opening at a corner where said power transmission mechanism is arranged, through which a portion of said power transmission mechanism faces said washing chamber, wherein said driving source includes a driving motor having a rotary axis;

said power transmission mechanism includes;

a driving gear attached to said rotary axis of said driving motor, a swing lever attached on said rotary axis of said driving motor swingable about said rotary axis, a spring provided at a position urging said swing lever to said driving gear, a group of transmission gears provided on said swing lever for transmitting rotation of said driving gear, and a rotary gear rotatably attached to said washing chamber member such that a portion thereof is exposed in said washing chamber through said opening of said washing chamber member; and said group of transmission gears is engageable/disengageable with said rotary gear in accordance with the swing of said swing lever.

12. A dishwasher comprising:

a cabinet having an opening on a front surface;

a door attached to said cabinet to open/close at said opening of said cabinet;

a washing chamber member provided in said cabinet and forming a washing chamber facing said opening of said cabinet;

a washing nozzle provided facing a certain direction of said washing chamber;

a circulation pump coupled to said washing nozzle, a bottom portion of said washing chamber and an external drain outlet;

a driving source provided outside said washing chamber;

a power transmission mechanism provided at a corner in said cabinet on one side of said cabinet, outside said washing chamber, and coupled to said driving source; and a control circuit for controlling said circulation pump and said driving source; wherein a dish washing basket placed on said washing chamber is rotated by said power transmission mechanism, further comprising:

an air blower controlled by said control circuit; wherein said washing chamber member forms a water tank at a bottom portion of said washing chamber;

said water tank including;

a bottom surface, and a sidewall having an air inlet which communicates and is coupled with said air blower and a water absorbing inlet which communicates and is coupled with said circulation pump;

said dishwasher further comprising:

a heater controlled by said control circuit arranged opposing to said air inlet in said water tank.

13. The dishwasher according to claim 12, wherein said control circuit can control said dishwasher in any of a plurality of operation modes using said circulation pump, said driving source, said air blower and said heater;

said dishwasher further comprising:

an operation panel connected to said control circuit and having a plurality of indicators which indicate operation modes of said dishwasher, wherein said control circuit flickers said plurality of indicators when an error is generated at any of said circulation pump, said driving source, said air blower and said heater, in accordance with a portion of said error.

14. The dishwasher according to claim 13, wherein said plurality of operation modes includes an operation mode having a washing step, a drying step and a temperature maintaining step;

in said washing step, said circulation pump operates so that washing water is jet out from said washing nozzle to said washing chamber;

in said drying step, said circulation pump discharges washing water from said washing chamber, and said heater and said air blower operate to feed hot air to said washing chamber; and in said temperature maintaining step, said heater heats air being fed to said washing chamber to a prescribed temperature lower than the temperature in said drying step but higher than room temperature.

15. The dishwasher according to claim 14, wherein said control circuit flickers said indicators in said drying step and said temperature maintaining step, and said control circuit flickers said indicators at a slower interval than flickering in said drying step, in said temperature maintaining step.

16. A dishwasher comprising:

a cabinet having an opening on a front surface;

a door attached to said cabinet to open/close at said opening of said cabinet;

a washing chamber member provided in said cabinet and forming a washing chamber facing said opening of said cabinet;

a washing nozzle provided facing a certain direction of said washing chamber;

a circulation pump coupled to said washing nozzle, a bottom portion of said washing chamber and an external drain outlet;

a driving source provided outside said washing chamber;

a power transmission mechanism provided at a corner in said cabinet on one side of said cabinet, outside said washing chamber, and coupled to said driving source; and a control circuit for controlling said circulation pump and said driving source; wherein a dish washing basket placed on said washing chamber is rotated by said power transmission mechanism, wherein said washing chamber member forms a water tank at a bottom portion of said washing chamber, said dishwasher further comprising:

a filter member placed on said water tank of said washing chamber and forming a bottom surface of said washing chamber, said filter member having a support portion provided at a prescribed position on its upper surface for supporting a rotary axis of said dish washing basket, wherein a bottom surface of said washing chamber has a first portion on which said filter member is placed and a remaining second portion, and said filter member and said washing chamber member are formed such that said upper surface of said filter member is flush with an upper surface of said second portion of said washing chamber.

17. A dishwasher comprising:

a cabinet having an opening on a front surface;

a door attached to said cabinet to open/close at said opening of said cabinet;

a washing chamber member provided in said cabinet and forming a washing chamber facing said opening of said cabinet;

a washing nozzle provided facing a certain direction of said washing chamber;

a circulation pump coupled to said washing nozzle, a bottom portion of said washing chamber and an external drain outlet;

a driving source provided outside said washing chamber;

a power transmission mechanism provided at a corner in said cabinet on one side of said cabinet, outside said washing chamber, and coupled to said driving source; and a control circuit for controlling said circulation pump and said driving source; wherein a dish washing basket placed on said washing chamber is rotated by said power transmission mechanism, wherein a water absorbing inlet is formed on a side surface of said water tank;

said circulation pump has a first surface having a washing outlet which communicates with said water absorbing inlet and communicates with said washing pipe, and a second surface having a drain outlet which communicates with a prescribed water outlet, said first and second surfaces intersecting at a certain angle θ;

said dishwasher further comprising:

an approximately V-shaped switching valve provided rotatable about the intersection of said first and second surfaces as a fulcrum in said circulation pump, and rotated selectively and watertightly closing said washing outlet or said drain outlet in accordance with water flow generated by said circulation pump.

18. A dishwasher comprising:

a cabinet having an opening on a front surface;

a door attached to said cabinet to open/close at said opening of said cabinet;

a washing chamber member provided in said cabinet and forming a washing chamber facing said opening of said cabinet;

a washing nozzle provided facing a certain direction of said washing chamber;

a circulation pump coupled to said washing nozzle, a bottom portion of said washing chamber and an external drain outlet;

a driving source provided outside said washing chamber;

a power transmission mechanism provided at a corner in said cabinet on one side of said cabinet, outside said washing chamber, and coupled to said driving source; and a control circuit for controlling said circulation pump and said driving source; wherein a dish washing basket placed on said washing chamber is rotated by said power transmission mechanism, and said dishwasher further comprising:

an operation panel and a buzzer connected to said control circuit, wherein said control circuit performs a demonstration operation of said dishwasher in response to a prescribed operation on said operation panel, rings said buzzer in response to an operation of a power key on said operation panel at the time of the demonstration operation of said dishwasher, and operates said dishwasher in a shorter operation cycle than a normal operation cycle in said demonstration of said dishwasher.

19. A dishwasher basket used with a dishwasher including a cabinet having an opening on a front surface, a door attached to be opened/closed at said opening of said cabinet, a washing chamber member provided in said cabinet and forming a washing chamber facing said opening of said cabinet, a washing nozzle provided facing a certain direction of said washing chamber, a circulation pump coupled to said washing nozzle, a bottom portion of said washing chamber and to an external drain outlet, a driving source provided outside said washing chamber, a power transmitting mechanism coupled to said driving source, and a control circuit controlling said circulation pump and said driving source, placed in said washing chamber and rotated by said power transmitting mechanism, said basket comprising:

a disk shaped bottom portion; and a columnar pole formed approximately vertical with respect to an upper surface of said bottom portion from the center of said bottom portion; wherein said bottom portion includes a plurality of radial ribs for supporting a plurality of dishes, said plurality of radial ribs each being formed from a lower outer periphery of said pole to an outer periphery of said bottom portion, so that when said dishwasher basket is rotated by the power transmitting mechanism, water from the washing nozzle contacts the plurality of plates supported by said plurality of radial ribs from the outer periphery of the dish toward the center surface of the dish.

* * * * *